US007018492B1

(12) United States Patent
Mumm et al.

(10) Patent No.: US 7,018,492 B1
(45) Date of Patent: Mar. 28, 2006

(54) CARPETS WITH IMPROVED FUZZ-RESISTANCE

(75) Inventors: Jeffrey H. Mumm, Marietta, GA (US); Hugh Chester Gardner, Roswell, GA (US)

(73) Assignee: Propex Fabrics, Inc., Austell, GA (US)

( * ) Notice: Subject to any disclaimer, the term of this patent is extended or adjusted under 35 U.S.C. 154(b) by 0 days.

(21) Appl. No.: 09/696,519

(22) Filed: Oct. 25, 2000

Related U.S. Application Data

(60) Provisional application No. 60/162,463, filed on Oct. 29, 1999.

(51) Int. Cl.
*D05C 15/00* (2006.01)

(52) U.S. Cl. ..... 156/72; 428/95; 428/96

(58) Field of Classification Search ..... 156/72, 156/305, 324; 428/95, 96, 97
See application file for complete search history.

(56) References Cited

U.S. PATENT DOCUMENTS

| | | | | |
|---|---|---|---|---|
| 3,390,035 | A | 6/1968 | Sands | 156/72 |
| 3,551,231 | A | 12/1970 | Smedberg | 156/72 |
| 3,583,938 | A | 6/1971 | Stahl | 280/28.5 |
| 3,684,600 | A | 8/1972 | Smedberg | |
| 3,745,054 | A | 7/1973 | Smedberg | 161/67 |
| 4,368,282 | A * | 1/1983 | Bogdany | 428/95 |
| 4,439,476 | A | 3/1984 | Guild | |
| 4,654,247 | A | 3/1987 | Randall, III et al. | |
| 4,808,459 | A * | 2/1989 | Smith et al. | 156/72 |
| 4,836,871 | A * | 6/1989 | Kato | 156/79 |
| 4,844,765 | A * | 7/1989 | Reith | 156/306.6 |
| 5,173,356 | A | 12/1992 | Eaton et al. | |
| 5,240,530 | A | 8/1993 | Fink | |
| 5,443,881 | A * | 8/1995 | Higgins et al. | 428/93 |
| 5,532,035 | A | 7/1996 | Corbin et al. | |
| 5,714,224 | A * | 2/1998 | Gerry | 428/95 |
| 5,925,434 | A | 7/1999 | Phillips et al. | |

FOREIGN PATENT DOCUMENTS

| | | |
|---|---|---|
| WO | PCT/US96/03485 | 3/1996 |
| WO | PCT/US98/03992 | 2/1998 |
| WO | PCT/US98/08634 | 4/1998 |

* cited by examiner

*Primary Examiner*—Jeff H. Aftergut
*Assistant Examiner*—John L. Goff
(74) *Attorney, Agent, or Firm*—King & Spalding LLP

(57) ABSTRACT

Tufted carpets bonded with thermoplastic binders and having improved resistance to fuzz formation due to removal of pile yarn filaments from tuft bundles comprise one or more backings, face yarn that forms a pile on one side and stitches on an opposite side, a thermoplastic binder that binds stitches and the backing or backings, and an organic polymer that bonds filaments of the stitches. Processes for making carpets comprise applying to a stitched side of a tufted backing a liquid stitch bind composition comprising an organic polymer component, removing a liquid component of the composition to bond filaments of the stitches and bonding stitches and one or more backings with a thermoplastic binder that is melted or applied as a melt in contact with the stitched side and the backing or backings and solidified.

39 Claims, 1 Drawing Sheet

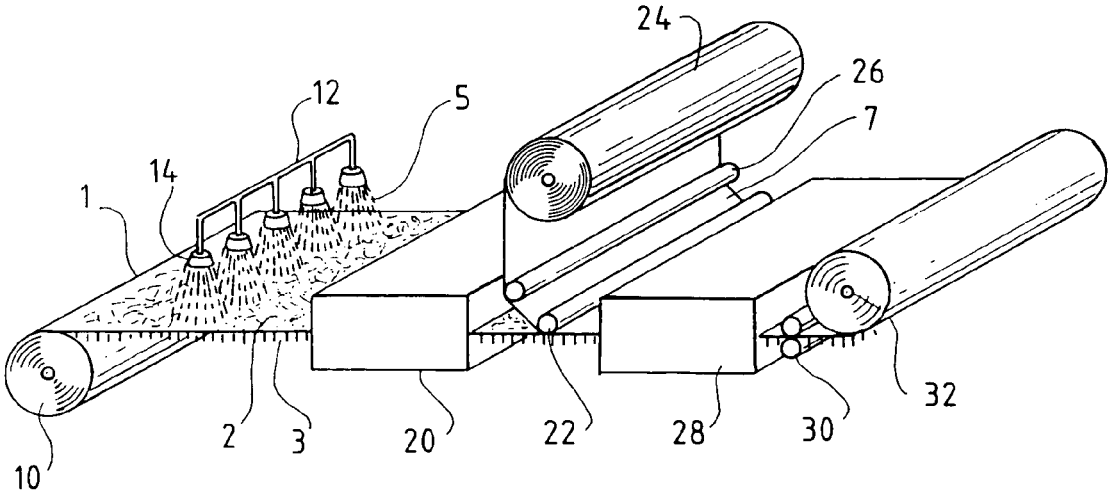
24
26
7
12
5
14
1
10
2
3
20
22
28
30
32

CARPETS WITH IMPROVED FUZZ-RESISTANCE

This application claims the benefit of U.S. Provisional Application No. 60/162,463 filed Oct. 29, 1999.

FIELD OF THE INVENTION

This invention relates to carpets and their manufacture and more particularly carpets and carpet manufacture involving thermoplastic binders.

BACKGROUND OF THE INVENTION

Tufted carpets generally comprise a backing, face yarn and a binder. The face yarn penetrates the backing such that a plurality of tufts projects from one side of the backing and a plurality of face yarn stitches is disposed on an opposite side of the backing. The binder is present on the stitched side, anchoring tufts in and to the backing. Many carpets also include an additional backing for added stability. In those carpets, face yarn typically penetrates a primary backing, as described above, and an additional backing, such as a relatively open weave secondary backing fabric, is secured to the stitched side with the binder. Alternative structures in which face yarn penetrates a composite backing made up of two or more individual components, such as superposed dual primary backings or primary and secondary backings, also are well known; a recent example is disclosed in International Application WO 98/49000. In manufacture of carpets, a backing is tufted with face yarn and the stitched side of the tufted backing is typically coated with a liquid binder formulation capable of being cured to form a solid binder that anchors tufts to the stitched surface or between that surface and an additional backing. The binder, both before and after curing, is commonly referred to as a "backcoat."

Currently, woven polypropylene fabrics are most commonly used as backings. Face yarns comprise a plurality of filaments and are typically continuous multifilament yarns or spun yarns formed by spinning staple fiber into yarn. Filaments of yarns most commonly used as face yarn comprise synthetic resins, such as nylon, olefin, polyester and acrylics, although natural fiber yarns such as wool yarns are also used. Conventional backcoats used in carpet manufacture are most commonly particulate-filled, aqueous latexes of organic polymer compositions that set up or cure on heating to drive off their aqueous contents. Crosslinkable styrene-butadiene copolymers are most commonly used as the organic polymer of the backcoat formulations. The particulate filler most commonly is calcium carbonate and typically is present in the latexes in significant amounts (e.g., 60–85 weight %) to impart viscosities high enough to allow application of backcoats uniformly over the entire surfaces of intermediate carpet structures with simple equipment during carpet manufacture.

Although carboxylated styrene-butadiene copolymers are most commonly used in filled latex binders due to cost and performance, the cured binders are deficient due to their uptake of water and tendency to lose considerable strength when wet. In finished carpets with such binders, contact with water, for example from spills and splashes, can lead to marked losses of tuft lock or tuft bind such that face yarn tufts are easily pulled out of the carpets. It has been proposed to reduce or eliminate the use of filled, aqueous latex binders by use of binders based on thermoplastic resins. In general, proposals of this type involve bonding the face yarn stitches to a backing or backings by cooling a softened or melted thermoplastic resin in contact with the stitched side of a tufted backing and, when used, with an additional backing, to solidify the resin. Thermoplastic resins used for adhering the stitches and the backing are those that exist in solid form at temperatures normally encountered during use of carpets but can be softened or melted in contact with backings and face yarn stitches, or softened or melted and then contacted while softened or melted with the backings and stitches, at temperatures low enough that the other components of the carpets are not damaged. Thermoplastic binders comprising such resins can be provided in solid form, such as a film or coating on or applied to backings, as powder or loose fiber applied to the backings or stitches, as loose fiber needled or otherwise affixed to backings, and as fabrics secured or applied to the backings or their stitched sides. The binders can also be provided with the resin thereof softened or melted, for example by extruding melted resin formulations directly onto the stitched side of a backing or by laminating a tufted primary backing to a secondary backing with softened or melted resin formulations applied to or between the backings as they are brought together. Carpets made using such binders are more resistant to loss of strength due to water uptake than carpets with conventional, cured carboxylated styrene-butadiene copolymer binders. Such alternative binders also can offer advantages over conventional carpets because thermoplastic binders are better suited for recycle to melt processing operations than conventional binders. Thus, while face yarns and backings most commonly used in carpets are composed primarily of thermoplastic resins capable of being reused in melt-forming operations, cured latex binders typically contain levels of crosslinked polymer solids that can make such reprocessing impractical due to burning, smoking and impairment of flow of melted resins.

AdBac® Composite System carpets with backings made and sold by Amoco Fabrics and Fibers Company are an example of known carpets with thermoplastic binders. In one embodiment, AdBac® System carpets use a light weight nonwoven web of filaments of a thermoplastic resin needled to a woven polypropylene carpet backing. After tufting the needled backing with face yarn, the structure is heated to melt the resin of the filaments of the web such that the melted resin flows around the face yarn stitches and their junctions with the backing. The resulting structure is cooled to solidify the melted resin, thereby anchoring the tufts and, when a secondary backing is also used, securing it to the stitched side of the tufted backing. Alternative AdBac® Composite System carpets have stitches and backings adhered through use of woven secondary backing fabrics coated with lower melting thermoplastic resin compositions that can be melted and cooled in contact with the stitched side of a tufted primary backing to secure the tufts and laminate the backings. AdBac® System carpets have better tuft lock retention when wet than conventional carpets. They also are lighter, more flexible and easier to handle than conventional carpets with their mineral-filled, cured latex binders and, therefore, easier to install. They also can be installed over a considerably broader range of temperatures and their backings and binders afford greater potential for melt reprocessing in carpet manufacture. Commonly assigned International Application PCT/US96/03485 discloses carpets, backings and carpet manufacture involving binders comprising thermoplastic resins and substantially free of latex and mineral fillers, including AdBac® Composite System carpets and backings and binders therefor.

Other proposals and concepts for carpets prepared using softened or melted thermoplastic resin compositions that are cooled in contact with face yarn stitches of a tufted backing and/or a secondary backing to help secure tufts and/or bond primary and secondary backings are found in commonly assigned U.S. Pat. No. 4,844,765, disclosing lamination of tufted primary carpet backings to secondary backings with a composite hot melt adhesive sheet made up of adhesive formulations with higher and lower melt viscosities; U.S. Pat. No. 5,240,530, disclosing lamination of tufted primary backings to secondary backings with a sheet of extruded isotactic polypropylene; U.S. Pat. No. 5,532,035 disclosing tufted fabrics of a single type of thermoplastic material in which a primary backing of nonwoven polyester fibers and lower melting polyester binder fibers is tufted with polyester face yarn and the tufts are anchored and a secondary backing is laminated by partial melting of the primary backing and then cooling the same; and European Patent Application 80304253.0 disclosing tufted pile fabrics in which tufts are secured to a primary backing and an anchor coat is formed by needling or otherwise applying to both surfaces of the backing a layer of low melting nylon or other fibers, tufting the backing with the applied layer of fibers, and melting the layer on the side of the backing opposite the pile surface.

A difficulty with carpets with thermoplastic binders, however, is their tendency to fuzz during use. Fuzzing occurs when individual filaments of yarn tufts pull completely or partially out of the tufts and manifests itself in a fuzzy appearance and pilling of the carpet pile and, in time, an uneven, thinning appearance. For many types of carpets, fuzzing is encountered less frequently and severely in carpets prepared with conventional aqueous latex binders. The difference may be related, at least in part, to different properties and behaviors of the softened or melted resins of thermoplastic binders and of aqueous liquid latex formulations as used as binders in carpet manufacture.

In the case of conventional aqueous latex binders, their liquid nature makes uniform application easy and inexpensive. Flow properties are easily controlled to achieve effective coating of stitched backing surfaces and wetting of filaments of the stitches by simple adjustment of filler, polymer and water levels of the formulations. Unfilled or low viscosity latex formulations are sometimes used in conjunction with conventional highly filled formulations. In most carpet constructions and with most common materials of construction, heating to drive off water and cure the latex binders results in good bonding of stitches to backings and of filaments within stitches. Surfactants can also be used to adjust surface tensions of binder formulations in relation to tuft stitches and backings. It also is known from U.S. Pat. No. 4,654,247 to prime face yarn stitches for application of latex binders by applying in advance of the binder an aqueous dispersion of surfactant or polymer with surface tension less than or equal to that of the face yarns; the primer is reported to promote uptake of binder by face yarns and reduce fuzzing of yarns that resist penetration by binders due to treatments against soiling, staining, mold, mildew and static buildup.

With thermoplastic binders, in contrast, dispersibility, flow properties and affinity to backings and face yarns of melted thermoplastic resins are less conducive to effective application and bonding. In some cases, uniform application of thermoplastic binders is hindered by their physical form. For example, thermoplastic binders in the form of loose fiber are difficult to apply consistently and uniformly over stitched backing surfaces; melting and cooling of the resin of the fibers can produce irregular gaps and thick and thin areas of binder, leaving entire stitches or groups of stitches unbonded or only superficially bonded. Powdered thermoplastic binders can be applied somewhat more uniformly than loose fibers but special equipment is usually needed. Thermoplastic films, sheets, coatings and nonwoven fabrics tend to be more effective, not only because their sheetlike or fabric form makes them well suited for application to the entire stitched side of a tufted backing, but also because they can be prepared to provide the thermoplastic binder resin in consistent weights per unit area tailored to carpet and manufacturing requirements. However, even the more uniformly applied thermoplastic binders suffer due to high viscosities and poor flow of their melted resins as compared to the liquid latex binders. Surface tensions of the melted thermoplastic resins can also lessen affinities to face yarns and backings and are not as easily adjusted as those of conventional aqueous latexes. High flow rate resins, special resin compositions, application of pressure to intermediate carpet structures to promote flow and improve distribution of melted resin, special application techniques and other measures can provide improvement but not to the degree desired and usually not without equipment modifications, added process complexity and increased cost.

Whatever the cause or causes, fuzzing in carpets with thermoplastic binders remains a problem and an obstacle to more widespread realization of the benefits of such carpets. There is a need for improvement so that filaments of face yarn tufts are more effectively held in the carpets.

SUMMARY OF THE INVENTION

This invention provides a solution to the difficulties described above. In one embodiment, the invention provides a process for manufacture of tufted carpets using thermoplastic binders in which improved bonding is achieved. In another embodiment, the invention provides carpets with improved fuzz resistance. In many cases, tuft lock is also improved. Such improvements are achieved while also retaining other benefits of carpets with thermoplastic binders, such as good retention of tuft bind strength when wet, lighter weight, greater flexibility, easier cold weather and cold climate installability, and greater potential for melt reprocessibility.

Briefly, in one embodiment, the invention provides an improvement to processes for manufacture of tufted carpets that comprise adhering to a stitched side of a tufted backing a plurality of stitches of face yarn comprising a plurality of filaments by cooling in contact with the stitched side a thermoplastic binder comprising a softened thermoplastic resin to solidify the softened resin, wherein the improvement comprises steps comprising applying to a plurality of stitches, before the resin solidifies, a stitch bind composition comprising a liquid component capable of being removed by heating at a temperature less than the temperature at which the tufted backing is damaged by heat and an organic polymer component capable of bonding filaments of the stitches on removal of the liquid component; and, after applying the stitch bind composition but before the resin solidifies, heating the stitch bind composition to substantially remove the liquid component without damaging the tufted backing.

In another embodiment, the invention provides a process for manufacture of carpets comprising the steps of providing a tufted backing having a stitched side with a plurality of stitches of face yarn comprising filaments, wherein filaments of a plurality of the stitches are bonded with an organic polymer, contacting the stitched side of the tufted backing with a thermoplastic binder comprising a thermoplastic resin capable of being softened in contact with the tufted backing, or of being softened and then contacted with the tufted backing, without damaging the tufted backing, heating the thermoplastic binder to soften the resin without damaging the tufted backing, and cooling the backing with softened resin in contact with the stitched side to solidify the resin. In an alternative to this embodiment, the tufted backing provided to the process also includes the thermoplastic binder, thereby rendering optional the step of contacting the tufted backing with the binder.

In another embodiment the invention provides an improvement to processes for making carpets that include steps comprising:

providing a tufted backing comprising a backing and having a pile side and an opposite stitched side, wherein the pile side has a plurality of tufts of face yarn that comprise a plurality of filaments and the stitched side has a plurality of stitches of the face yarn;

contacting the stitched side of the tufted backing with a thermoplastic binder that comprises a thermoplastic resin capable of being softened in contact with the tufted backing, or of being softened and then contacted with the tufted backing, without damaging the tufted backing;

heating the thermoplastic binder to soften the thermoplastic resin without damaging the tufted backing; and cooling the thermoplastic binder with the softened resin thereof in contact with at least the stitched side of the tufted backing to solidify the thermoplastic resin;

wherein the improvement to such processes comprises steps that comprise applying to a plurality of stitches, before the resin solidifies, a stitch bind composition that comprises a liquid component capable of being removed by heating at a temperature less than a temperature at which the tufted backing is damaged by heat and an organic polymer component capable of bonding filaments of the stitches on removal of the liquid component; and after applying the stitch bind composition but before the resin solidifies, heating the stitch bind composition to remove the liquid component without damaging the tufted backing.

In another embodiment, the invention provides a process for making carpets comprising steps that comprise bonding to a stitched side of a tufted backing a plurality of stitches of face yarn comprising a plurality of filaments by cooling in contact with the stitched side a binder comprising a softened thermoplastic resin to solidify the resin;

applying to a plurality of the stitches, before the resin solidifies, a stitch bind composition comprising a liquid component capable of being removed by heating at a temperature less than a temperature at which the tufted backing is damaged by heat and an organic polymer component capable of bonding filaments of the stitches on removal of the liquid component; and heating the stitch bind composition, after application thereof to the stitches and before the resin solidifies, at a temperature less than a temperature at which the tufted backing is damaged by heat to remove the liquid component.

In a further embodiment, the invention provides a process for making a tufted carpet comprising steps that comprise providing a tufted backing comprising a backing and face yarn comprising a plurality of filaments, wherein face yarn penetrates the backing and forms a pile surface comprising a plurality of tufts on one side of the backing and a plurality of stitches on an opposite, stitched side of the backing;

applying to the stitched side of the tufted backing and in contact with a plurality of the stitches a stitch bind composition comprising a liquid component capable of being removed by heating at a temperature less than a temperature at which the tufted backing is damaged by heat and an organic polymer component capable of bonding filaments of the stitches on removal of the liquid component;

contacting the stitched side of the tufted backing with a binder comprising a thermoplastic resin capable of being softened in contact with the tufted backing, or of being softened and then contacted with the tufted backing, without damaging the tufted backing;

heating the tufted backing in contact with the stitch bind composition to remove the liquid component without damaging the tufted backing;

heating the binder to soften the thermoplastic resin without damaging the tufted backing; and cooling the binder with the softened resin thereof in contact with the stitched side of the tufted backing to solidify the resin.

In a more specific embodiment using an additional backing structure that is separate from the tufted backing, the invention provides a process for manufacturing carpets comprising steps that comprise providing a tufted primary backing having a pile side comprising face yarn tufts and an opposite side having a plurality of stitches of face yarn;

applying to a plurality of the stitches a stitch bind composition comprising a liquid component capable of being removed by heating at a temperature less than a temperature at which the tufted backing is damaged by heat and an organic polymer component capable of bonding filaments of the stitches on removal of the liquid component;

contacting the tufted primary backing, an additional backing and a binder comprising a thermoplastic resin capable of being softened in contact with the tufted backing and the additional backing, or of being softened and then contacted with the tufted backing and the additional backing, without damaging the tufted backing or the additional backing, to form an intermediate structure having binder disposed between the stitched side of the tufted primary backing and the additional backing;

heating the tufted primary backing or the intermediate structure after application of the stitch bind composition to remove the liquid component without damaging the tufted primary or additional backings;

heating the binder to soften the thermoplastic resin without damaging the tufted primary or additional backing; and cooling the intermediate structure with the thermoplastic resin in softened form to solidify the resin.

Another aspect of the invention provides improved carpets prepared according to the invented process.

In yet another embodiment, the invention provides tufted carpets comprising a backing, face yarn comprising a plurality of filaments, an organic polymer component and a thermoplastic binder, wherein the face yarn penetrates the backing such that a plurality of tufts of the face yarn project from a surface of the backing and a plurality of face yarn stitches are disposed on an opposite surface of the backing, a plurality of filaments of the stitches are bonded by the organic polymer component, and a plurality of stitches are bonded to the backing with the thermoplastic binder. In another embodiment, carpets according to the invention further comprise an additional backing bonded to at least the stitches with the thermoplastic binder.

The invented process is described with reference to "steps" thereof to make clear that, except as expressed otherwise, it is the physical manipulations or operations, without regard to timing or sequence that make up the invented process. As will be evident from the detailed description appearing below, except as otherwise made clear in context, steps may be carried out together or separately and in any sequence.

Also for purposes hereof, the expression "thermoplastic binder" is to be understood to mean a material that comprises a thermoplastic resin and does not contain added thermosetting, crosslinked or crosslinkable components to an extent that destroys or significantly reduces the resin's fundamental thermoplastic characteristic of being or becoming plastic, or softened and formable, on application of appropriate heat. Minor amounts of crosslinked or crosslinkable components or moieties inherently present in commercially available thermoplastic resins or formed during melt processing thereof are not excluded by the expression "thermoplastic binder", nor are such components or moieties added to thermoplastic resins or binders for the purpose of improving performance of the resins in melt processing. An example of the former are gel particles, typically comprising crosslinked polymer solids, that are normally present in minor amounts in fiber, film and molding grade thermoplastic resins supplied by some commercial manufacturers or that can form in minor amounts during melt processing thereof. An example of the latter is the addition of polyfunctional compounds, such as organic tricarboxylic acids, to polyethylene terephthalate and other thermoplastic polyesters to promote crosslinking to increase melt strength in melt processing.

Except as otherwise indicated, the term "softened" when used in reference to thermoplastic resins of the thermoplastic binders used according to the invention means that the resin is in a plastic state, such that it is capable of being formed and, on cooling, will retain such form. Thus, unless context is otherwise, the term "softened" includes resins in both heat-softened and melted states.

The expression "osy" as used herein is an abbreviation for "ounces per square yard." Unless indicated otherwise in context, the term "copolymer" is used herein in a broad sense to refer to polymers of two or more monomers. The term "suspension" is used interchangeably with the term "dispersion" to refer to a two-phase system having solid particles suspended or dispersed in a continuous liquid phase. The term "emulsion" refers to a liquid—liquid multiphase system having a continuous liquid phase and one or more other liquid phases dispersed therein as a discontinuous phase. Unless stated otherwise, the abbreviation "MI" refers to polymer melt flow rate determined according to ASTM D1238 (190° C./2.16 kg) and expressed in grams per ten minutes (g/10 min.). Also unless otherwise indicated, viscosities referred to herein are Brookfield viscosities determined by ASTM D2196 Method A (1995) and expressed in centipoises (cps). Tuft Bind strengths and Fuzz Ratings are determined as described in connection with the Examples.

BRIEF DESCRIPTION OF THE DRAWING

The invention is described with reference to the drawing, which depicts a preferred embodiment of the invented process.

DETAILED DESCRIPTION

In greater detail, the invention solves the problem of fuzzing of carpets made with thermoplastic binders through the use of a stitch bind composition that is applied to the yarn bundles disposed as stitches on the stitched side of a tufted backing and imparts improved retention of filaments and fuzz resistance to carpets. The stitch bind composition includes a liquid component that aids in achieving application of the composition so that it contacts filaments of the stitches, but is easily removed during carpet manufacture. The stitch bind composition also includes an organic polymer component that is capable of bonding filaments of the stitches on removal of the liquid component. The organic polymer component is preferably used in a form that promotes its contact with filaments of the tuft stitches. In addition to imparting bonding of filaments in the face yarn stitches, the organic polymer component or its residue can contribute to bonding of tuft stitches to backing surfaces. The enhanced bonding of filaments within stitches results in significant improvements in fuzz resistance of carpets as compared to known carpet structures in which tuft lock, or tuft lock and lamination of primary and secondary backings, is accomplished using thermoplastic binders. Surprisingly, improved fuzz resistance is achieved even in carpets according to the invention having constructions or made from materials such that fuzz resistance is difficult to achieve even with conventional latex binders.

The dramatic improvements in fuzz resistance achieved according to the invention are accomplished with surprisingly low levels of organic polymer component. Use of the stitch bind composition in amounts providing as little as a fraction of an ounce of organic polymer component or residue thereof per square yard of finished carpet can provide significant improvements in fuzz resistance. Another advantage of the invention is the improved tuft bind that often accompanies the improved fuzz resistance imparted by the organic polymer component or its residue. Not only do individual filaments of tufts resist fuzzing better than in known carpets, other things being equal, but tufts are less prone to being pulled out or otherwise removed from finished carpet structures in handling, installation and use. For carpets according to the invention, tuft bind strengths according to ASTM D1335 are often at least about 2 pounds in cut pile carpets and at least about 5 pounds in loop pile carpets, and preferably greater than 3 pounds and 6.25 pounds, respectively. The form and low levels of stitch bind composition used to achieve such improvements are such that the invented process can be implemented without complicated and expensive equipment additions or modifications. Further, carpets according to the invention have the water resistance benefits of thermoplastic binders and the potential for recycle by melt processing.

Carpets according to the invention, when constructed from thermoplastic backings and face yarns, are advantageous by reason of their potential for reuse in plastics reprocessing operations. As noted above, use of thermoplastic binders, as opposed to conventional latexes, avoids the crosslinked latex particles that typically result from curing conventional latexes and, in turn, difficulties they cause in attempts to reprocess the same in melt fabrication processes. Consequently, not only trim and waste from carpet manufacturing operations, but even post-consumer carpet are more easily used in recycle operations in which plastic waste is reduced to a form and size suitable for use in extrusion, molding, spinning or other melt processing operations and so-processed either alone or blended with virgin or other plastics recycle streams. Preferred organic polymer components of the invented carpets are processible with plastics from backings, face yarns and thermoplastic binders in melt reprocessing operations, and even in the case of organic polymer compositions normally considered incompatible or ill-suited for such operations, the levels used or present for achieving improved fuzz resistance are often low enough that they do not impair reprocessing. The invented carpets and process also afford opportunities for avoiding the expense of recycle operations in which pile surfaces are sheared to remove face yarn tufts for reuse of the plastics thereof, and for disposal of backings and binders through use in melt reprocessing operations even when pile surfaces are sheared.

The benefits of the invented carpets provide opportunities to expand utility of carpets with thermoplastic binders to a broader range of applications, many of which have been considered beyond the reach of such carpets due to their demanding requirements. Specific examples include commercial carpets, such as are used in office buildings, airports, schools and the like, and hospitality carpets, such as hotel and motel carpeting, all of which are subject to heavy wear due to extensive and rigorous traffic, frequent cleaning and sometimes careless or inattentive use. Benefits of the invention can be realized over the entire life of a carpet, including greater potential for reuse of carpet materials during manufacture, easier and less labor-intensive installation due to the carpets' lower weights, expanded cold weather and cold climate installability due to their greater flexibility, better appearance during use and longer useful life due to reduced fuzzing and retention of tuft lock when exposed to water, and the potential for melt reprocessing instead of disposal at the end of the carpet's life.

As described above, in one of its aspects the invention provides a process for manufacture of carpets using thermoplastic binders to anchor tufts of face yarn to or between backings wherein improved retention of filaments of the tufts is achieved through use of a stitch bind composition that is applied to the stitches of a tufted backing and bonds filaments of a plurality of stitches so that they are more resistant to being removed from the tufts that form the carpet pile. The process and the improved carpet performance it provides are broadly applicable in manufacture of carpets in which stitches of face yarn are anchored to a backing or between backings by cooling a thermoplastic binder comprising softened or melted thermoplastic resin in contact with the stitched side of a tufted backing or between such a stitched side and an additional backing. Such processes can vary considerably in their specific aspects but they preferably comprise basic steps that involve providing a tufted backing having a pile side comprising face yarn tufts and a stitched side having face yarn stitches, contacting the stitched side of the tufted backing with a thermoplastic binder comprising a thermoplastic resin capable of being softened in contact with the tufted backing, or of being softened and then contacted with the tufted backing, without damage to the tufted backing, heating the thermoplastic binder to soften the resin without damaging the tufted backing, and cooling the binder with the softened resin thereof in contact with the stitched side of the tufted backing to solidify the resin. When an additional backing is to be bonded to the stitched side of the tufted backing in such processes, the processes include a step in which the additional backing, thermoplastic binder and tufted backing are contacted to form an intermediate structure in which the binder is disposed between the stitched side of the tufted backing and the additional backing, and a step in which the intermediate structure with the thermoplastic resin of the thermoplastic binder in softened form is cooled to solidify the resin. The improvements according to the present invention result from including in such processes, before the softened resin of the thermoplastic binder solidifies, steps comprising applying to a plurality of the stitches a stitch bind composition comprising an organic polymer component capable of bonding filaments of the stitches and a liquid carrier for the organic polymer component that can be removed by heating without damaging the tufted backing, and heating the stitch bind composition, after application thereof, to remove the liquid component without damaging the tufted backing.

Thus, in some of its embodiments, the process according to the invention may be considered an improvement that is applicable to a wide range of processes for carpet manufacture utilizing thermoplastic binders. In other embodiments, the invention resides in processes for manufacture of carpets in which particular steps or aspects or combinations thereof provide new and improved results. The drawing illustrates an embodiment of a process according to the invention. While the process is susceptible, without departing from the scope of the invention, to variation in its steps, their sequence, materials used therein and in other respects, the drawing and the following description thereof will contribute to understanding of both the particular embodiment exemplified in the drawing and of various broader aspects of the invention.

In the process illustrated in the drawing, stitch bind composition is applied to a stitched side of a tufted backing, the backing with applied stitch bind composition is heated to remove the liquid component, the result is contacted with a thermoplastic binder and then heated to soften or melt the resin of the binder, and the stitched side of the backing in contact with the softened or melted resin of the binder is cooled to solidify the resin. Referring to the drawing, tufted backing 1, comprising a backing having a pile formed from face yarn tufts extending therefrom on pile side 3 and face yarn stitches disposed on an opposite, stitched side 2 is unwound from roll 10. The tufted backing, with its stitched side up and pile side down, is advanced past applicator 12 at which stitch bind composition 5, in liquid form, is applied to the stitched side into contact with a plurality of stitches across the width of the tufted backing. Applicator 12 has spray heads 14 configured to apply a spray to the stitched side across its width as the tufted backing advances. The applicator includes a reservoir and associated controls, pump and transfer lines (not shown) for holding the stitch bind composition and delivering it to the nozzles under pressure adequate to form a spray. The stitch bind composition is a solution, suspension or emulsion comprising organic polymer and liquid components. The composition is formulated with a viscosity effective for coating or penetrating the stitches and organic polymer content effective for bonding filaments of the stitches after the liquid component is removed.

The tufted backing with stitch bind composition applied to its stitched side is passed to oven 20. During passage through the oven, the backing with applied stitch bind composition is heated to drive off the liquid of the stitch bind composition, leaving the organic polymer component or a residue thereof that bonds filaments of the stitches. Heating is conducted at a temperature and for a time sufficient for substantial removal of the liquid of the stitch bind-composition but without damaging the tufted backing. Vapors of the liquid component are removed from the oven by a suitable vent or exhaust system (not shown).

From oven 20, the tufted backing with organic polymer component or residue bonding filaments of a plurality of the stitches is conveyed to roll 22 at which it is brought into contact with thermoplastic binder 7. In the embodiment of the invention illustrated in the drawing, the thermoplastic binder is in sheet-like form, such as a film or a nonwoven fabric comprising a thermoplastic resin that softens or melts at a temperature below the temperature at which the tufted backing is damaged by heat. The binder is supplied from roll 24 over guide roll 26 and into contact with the stitched side of the tufted backing at roll 22. It will be appreciated that the equipment configuration illustrated in the drawing is also suitable for use of other thermoplastic binders that can be supplied from a roll, such as other fibrous webs or assemblies or additional backings that include or incorporate a thermoplastic binder.

The tufted backing with its stitched side in contact with the binder is then passed to oven 28 in which the assembly is heated at a temperature and for a time such that the resin of the thermoplastic binder softens or melts without damage to the backing or face yarn. From oven 28, the assembly with softened or melted thermoplastic resin is passed through nip roll system 30. The nip roll assembly is located near enough the exit of the oven that the resin of the thermoplastic binder is still in a softened or melted state when the assembly passes through the nip. Application of force during passage through the nip between the rolls compresses the resin into and around the tuft stitches, thereby promoting more uniform distribution of softened or melted resin throughout the structure. The resulting assembly cools after leaving the nip roll system and the softened or melted resin solidifies. The resulting carpet structure is then collected on takeup roll 32.

The invention is not to be considered limited to the preferred embodiments, materials, equipment configurations or other features depicted in the drawing or described above. While the process and equipment configuration illustrated in the drawing uses thermoplastic binder supplied from a roll, it will be appreciated that when binders in other forms are used, the illustrated binder supply and guide rolls can be eliminated and suitable alternative feeding devices, such as hoppers, extruders, and other solids and liquids feeders, can be added. Other equipment illustrated in the figure can also be varied. Belt and screen conveyors are suitable alternatives to the various feed and guide rolls depicted in the drawing. Hot air and forced air ovens are well suited for heating the various intermediate structures; however, other suitable equipment such as heated rolls, electric and infrared heaters and other suitable means can be utilized provided heat transfer capabilities are adequate to achieve suitable temperatures and dwell times.

In a variation of the process illustrated in the drawing, the tufted backing has a thermoplastic binder included or incorporated therein, such that a separate step for contacting the binder and the stitched side of the backing can be eliminated or employed to contact additional binder or a binder in different form with the backing. Another variation of the process comprises contacting the stitched side of the tufted backing, thermoplastic binder and an additional backing to form an intermediate structure with the binder disposed between the stitched side and the additional backing; heating the binder to soften the resin thereof and cooling the intermediate structure to solidify the softened resin results in a carpet structure having stitches anchored between the backings by the solidified resin. In such processes, either or both of the tufted backing and the additional backing can include or incorporate a thermoplastic binder. Thus, referring again to the drawing, an additional backing, such as a secondary backing, having a coating of suitably low softening thermoplastic resin formulation or a nonwoven web of filaments of such a resin formulation needled thereto, can be supplied from roll 24 into contact with stitched side of tufted backing at roll 22. The resulting intermediate structure advances to oven 28 where it is heated to soften the resin of the binder, again without damaging the backings or face yarn, and then to the nip roll assembly and is taken up after cooling to solidify the resin of the binder.

In another preferred embodiment of the process, the tufted backing is provided with filaments of its stitches already bonded by an organic polymer or residue thereof. In such an embodiment, steps of the process comprise contacting the tufted backing with a thermoplastic binder, heating the thermoplastic binder to soften the resin thereof and cooling the softened resin to solidify the resin in contact with the stitched side of the tufted backing. The tufted backing provided to such a process can also include or have incorporated into the backing thereof a thermoplastic binder, in which case steps of the process comprise heating the binder to soften the resin thereof and cooling the softened resin to solidify the same in contact with the stitched side of the tufted backing.

Irrespective of particular steps and combinations thereof used in the invented process, preferred materials used therein include tufted backings in which the backing comprises a woven polypropylene fabric and the face yarns comprise filaments of polypropylene, polyester or nylon. More preferably, the backing is a plain weave fabric woven from polypropylene tapes. Carpet yarns are more preferably continuous multifilament yarns and spun yarns, which typically are textured or bulked, such as by one or more of entanglement, crimping, twisting, cabling, and also can be heat set to improve retention of texture.

Preferred thermoplastic binders are films, coatings and nonwoven fabrics, including continuous filament nonwovens, such as spunbonded and centrifugally spun webs, and staple fiber webs, such as needlepunched, thermal bonded and carded webs. Such binders more preferably have weights of about 1 to about 15 osy. The thermoplastic resins of the binders melt at temperatures above about 50° C., and preferably above about 60° C., because lower melting resins may not withstand heat encountered in use of final carpets. In processes in which a thermoplastic binder is contacted with a tufted backing with the resin of the binder in solid form and then heated in contact with the backing to soften the resin, the resin of such binders preferably softens at about 100 to about 145° C. In processes in which softening or melting of the resin of a thermoplastic binder precedes contacting of the binder and a tufted backing, higher melting resins are suitable provided they can be contacted with the tufted backing and any additional backings that are used with the resin in softened or melted form without damage to the tufted and other backings. In either case, thermoplastic resins comprising at least one polyolefin homopolymer or copolymer resin that softens within a suitable temperature range are particularly useful. Particularly preferred resins include polyethylene resins (including high, low and linear low density resins and so-called metallocene polyethylenes), polypropylene resins (including metallocene polypropylenes), copolymers of ethylene and propylene, optionally with other monomers (including both ethylene and propylene dominated copolymers, block, random and segmented copolymers and elastomeric and thermoplastic-elastomer copolymer resins), and combinations of such resins or comprising one or more such resin and one or more other resins.

Additional backings, when used, preferably are polypropylene fabrics, including those woven in close or relatively open or coarse weaves, and nonwoven fabrics comprising polypropylene or polyester filaments. More preferably, woven backings are woven from tapes in one direction and spun or continuous filament yarns in the other direction in a plain or leno weave.

Preferred backings, for either or both of the backing that is tufted and additional backing, when used, also include such backings that include or have incorporated a thermoplastic binder. Backing-binder composites comprising thermoplastic binder at one or both surfaces in the form of an adhered layer comprising a suitably low softening point thermoplastic resin or an affixed nonwoven fabric having filaments comprising such a resin are particularly suitable. Backings coated with a layer comprising the thermoplastic resin or having needled or thermally bonded nonwoven webs of filaments comprising the resin are most preferred.

The stitch bind composition is most preferably a dispersion or emulsion of organic polymer having a viscosity of about 1.5 to about 400 centipoises and organic polymer content of about 5 to about 25 weight %. Particularly preferred stitch bind compositions comprise stable aqueous dispersions and emulsions of organic film-forming polymers, and particularly film forming olefin-unsaturated acid, -unsaturated acid ester and -diene copolymers. Specific examples include film-forming ethylene acrylic acid copolymers, styrene acrylate copolymers and styrene butadiene copolymers.

When using the preferred materials described above, preferred operating conditions for the invented process include use of the stitch bind composition in amounts effective to provide about 0.25 to about 2 osy of organic polymer to the stitched side of the tufted backing, heating at about 105 to about 140° C. to remove the liquid of the stitch bind composition, use of thermoplastic binder in amounts providing about 2 to about 12 osy in finished carpets, heating at about 105 to about 150° C. to soften or melt the resin of the binder without damaging the tufted backing or additional backings that may be used, and, when force is applied to promote flow or distribution of softened or melted resin of the thermoplastic binder, force of about 10 to about 70 pounds per linear inch.

While the invented process has been described above in reference to various steps, compositions, constructions and other features and aspects reflecting operational, materials and finished product preferences, the invention contemplates not only broader applicability to manufacture of carpets using thermoplastic binders but also considerable variation in both its broad and more specific aspects, including its steps, combinations and operational aspects thereof, choices of materials used therein, features of products thereof and in other respects. Broader aspects of the invented process are discussed below.

Generally, the stitch bind composition used according to the invention comprises an organic polymer component that is capable of bonding filaments of the face yarn stitches, and a liquid component that serves as a carrier for the organic polymer and is capable of being removed by heating at a temperature below that at which the tufted backing is damaged by heat. The liquid form of the stitch bind composition facilitates application thereof to the stitched side of the tufted backing so that it contacts a plurality of stitches thereof. The composition as used in the process preferably has viscosities suited to coating or penetrating yarn bundles disposed as stitches on the stitched side of tufted backings so that it contacts filaments thereof.

The composition is conveniently used as a dispersion, emulsion or solution of the organic polymer component in the liquid component, and preferably has a viscosity of about 0.5 to about 3000 or about 0.5 to about 2900 centipoises to afford good coating of stitches. More preferably, viscosity is about 1 to about 1200 centipoises, with about 1.5 to about 400 centipoises being most preferred. It is also preferred that the organic polymer content of the stitch bind composition, whether dissolved, suspended or emulsified, be at least about 5 weight %; at lower levels, volumes of stitch bind composition containing adequate organic polymer for effective bonding of filaments can require handling and removal of excessive amounts of liquid component. More preferably, organic polymer contents are about 5 to about 60 weight %. Higher levels can lead to viscosities not conducive to efficient application of the composition and effective penetration of the filament bundles making up the stitches. It also is beneficial for process efficiency to use stable dispersions or emulsions of organic polymer component in the liquid component. As is known, stability of dispersions and emulsions is influenced by factors such as composition and particle size of dispersed or emulsified particles, ionic or polar character of the particles, composition and properties of the liquid component of the system and presence of other components. While the range of factors and complexity of their interrelationships make quantitative characterization of stability difficult, it is adequate for purposes of the invention to characterize preferred stitch bind compositions as stable dispersions, emulsions and solutions with suitable viscosities and organic polymer contents. For purposes hereof, the term "stable", when used in reference to a dispersion or emulsion, means that the dispersion or emulsion retains its two-phase character of relatively small particles or droplets of organic polymer component distributed essentially uniformly in a liquid medium, or, when used in reference to a solution, that the solution retains its one phase character, for a prolonged period of time at temperatures convenient for handling and use of the same according to the invented process, for example at a temperature within the range of about 5 to about 60° C. for a period of one or more days. Stable dispersions and emulsions of organic polymer in suitable liquids with organic polymer contents of about 10 to about 40 weight % and viscosities described above, and especially about 1.5 to about 175 cps are particularly preferred.

The organic polymer component of the stitch bind composition is a material that, on removal of the liquid component, bonds filaments of the stitches. Such bonding of filaments of the stitches may be provided by the organic polymer component as such or by a residue resulting from reaction of the organic polymer component, or reaction thereof with other components of the stitch bind composition, on removal of the liquid component. The organic polymer or its residue bonds filaments of the stitches in the sense that it encapsulates or agglomerates between or around filaments of the stitches with sufficient strength to make filaments of the tufts more resistant to being removed. Film-forming organic polymers generally have adequate strength for such purposes and are preferred materials for the organic polymer of the stitch bind composition. As is known, film-forming characteristics of a polymer are a function of a number of properties and interrelationships, including composition, polymer chain flexibility and molecular weight, and interactions with particular substrates to which it is applied.

Preferred organic polymer components also are compositions that can be formulated with a suitably low boiling liquid component to provide dispersions, emulsions or solutions having the preferred organic polymer contents and viscosities described above with respect to the stitch bind composition. Polymers capable of forming stable aqueous dispersions or emulsions are particularly preferred due to the inert nature of water relative to other carpet components and the relatively low temperatures that can be used for heating to remove the same in the process. Water-soluble polymers, while effective for imparting fuzz resistance, are less preferred than water-based suspensions and emulsions because in finished carpets, water-solubility can lead to loss of fuzz resistance due to contact with water such as from spills, splashes and cleaning. Preferred organic polymers also are compositions that are swelled by not more than about 20% of their weight in contact with water at room temperature. Higher levels of moisture uptake by the polymer may affect its ability to bond filaments and, in finished carpets, may also diminish tuft bind strength.

Natural and synthetic organic polymers are suitable for use according to the invention. The term "organic polymer" is used in a broad sense to mean any polymeric or oligomeric material in which the repeat units of the polymer or oligomer chain comprise one or more carbon atoms to which is bonded one or more hydrogen atoms. Synthetic polymers are preferred due to their generally greater resistance to biodegradability than natural materials. Suitable synthetic polymers include thermoplastic polymers as well as crosslinking polymers that set up or cure into rubbery or intractable solids on heating and/or removal of the liquid component of the stitch bind composition. Thermoplastic materials are preferred for their greater processibility with other materials in melt reprocessing carpet manufacturing scrap and waste as well as spent carpets. Preferred thermoplastic polymers melt at temperatures above about 50° C., and more preferably between about 60 and about 140° C. Lower melting polymers can soften at temperatures close to those experienced in use of carpets, to the detriment of fuzz resistance. Higher melting polymers are useful, particularly when backings and face yarns are composed of suitably high softening point polymer components or other materials that can withstand the melting temperatures; however, backings most commonly used are composed of polypropylene resins, which melt at about 168° C., and accordingly, organic polymers with melting points up to about 140° C. are most useful because softening or melting thereof during heating to remove the liquid component of the stitch bind composition can result in flow or deformation of the polymer so that it better contacts or encapsulates filaments of the stitches.

Examples of polymers suitable as the organic polymer component of the liquid stitch bind composition include the thermoplastic and/or crosslinkable olefin-acid, -ester and -diene copolymers described above, specific examples of which include those previously identified and ethylene vinyl acetate copolymers, styrene-acrylate-acrylonitrile copolymers and vinyl chloride acrylic acid copolymers. Other thermoplastic olefinic polymers, including copolymers, are also suitable as are urethane polymers. Specific examples include vinyl chloride and vinylidene chloride polymers, maleated and other acid-grafted polyethylenes and polypropylenes and aliphatic urethanes. Examples of crosslinkable organic polymers suitable as the organic polymer component include styrene acrylate copolymers, carboxylated styrene butadiene copolymers, carboxylated and other crosslinking or crosslinkable acrylic polymers and crosslinkable ethylene vinyl acetate copolymers. As is known, crosslinkable polymers can be made crosslinking by addition of suitable crosslinking agents for the polymers. Examples of typical carboxyl-reactive crosslinking agents include melamine-formaldehyde resins, phenol-formaldehyde resins, epoxy resins, zinc complexes, polyamines and urea-formaldehyde resins.

Particularly preferred organic polymers used as components of the stitch bind compositions are ethylene-acrylic acid copolymers, styrene-acrylate copolymers, styrene-acrylate-acrylonitrile copolymers and carboxylated styrene-butadiene copolymers. Among these, the ethylene acrylic acid copolymers, and particularly those with about 10 to about 30 wt % ethylene units are preferred thermoplastic organic polymers due to their good aqueous dispersibility at effective polymer contents and viscosities and excellent filament bonding capabilities with a wide range of face yarn compositions and configurations. These preferred polymers are most preferably used in the form of stable aqueous dispersions or emulsions having viscosities of about 1 to about 500 cps and organic polymer contents of about 5 to about 40 weight %, and most preferably with viscosities of about 1.2 to about 400 cps and organic polymer contents of about 10 to about 25 wt %.

The liquid component of the stitch bind composition is a liquid in which the organic polymer can be dispersed, emulsified or dissolved and which boils or vaporizes at a temperature such that it can be removed by heating at a temperature below that at which the other carpet materials used in the process are damaged by heat. As noted above, aqueous liquid components are most preferred because water is easily removed at temperatures well below those at which carpet components are damaged by heat and is a good medium for dispersion and emulsification of many suitable organic polymers. While aqueous liquid components have significant practical advantages, other suitably performing liquids include low boiling alcohols, ketones and halogenated hydrocarbons. Preferably, the liquid component is one that can be removed at temperatures not greater than about 140° C. to provide a safety margin against damaging backings and face yarn during removal of the component.

The stitch bind composition can also contain stabilizers, dispersing aids, thickeners, plasticizers, crosslinking agents, surfactants and other additives if desired. Inclusion of thickening agents can be beneficial for adjusting viscosities of stitch bind compositions to desired levels. As described above, crosslinking agents can be added to stitch bind compositions in which a crosslinkable organic polymer is present to provide a crosslinking organic polymer component. Application of stitch bind composition by foam and froth application techniques can benefit from inclusion in the compositions of surfactants to assist in forming and maintaining foams and froths for process use; however, use of too much surfactant can be detrimental to fuzz resistance due to increased moisture uptake often imparted by surfactants.

While suitable stitch bind compositions can be formulated from organic polymer and liquid components and other components as desired, a variety of commercially available dispersions, emulsions and other materials can be used as, or to prepare, suitable compositions. Specific examples of commercially available materials include aqueous styrene acrylate copolymer emulsions such as those available from Rohm and Haas Company under the Rhoplex® name, styrene acrylate copolymer formulations, acrylic acid-styrene-acrylonitrile formulations and self-crosslinking carboxylated styrene-butadiene copolymer emulsions known as Acronal® and Styrofan®, respectively, from BASF, aqueous ethylene-acrylic acid copolymer formulations available from Michelman Corp. under the Michem® trademark, self-crosslinking acrylic polymer and ethylene-vinyl acetate emulsions sold under National Starch and Chemical Company's Nacrylic® and Dur-O-Set® names, aqueous, anionic emulsions of acrylic polymers such as Hycar® Acrylic Emulsions from BFGoodrich, aqueous anionic emulsions of crosslinking or carboxylated vinyl chloride acrylic copolymers such as Vycar™ PVC Emulsions from BFGoodrich, crosslinking and carboxylated styrene-butadiene copolymer emulsions such as Good-rite® Styrene-Butadiene Emulsions from BFGoodrich and aqueous aliphatic urethane formulations such as Sancure® Waterborne Aliphatic Urethane Polymers from BFGoodrich. Many of these materials are available as stable, 30 to 50 wt % polymer content formulations with viscosities generally in the range of about 30 to about 1000 cps and can be adjusted to polymer contents, viscosities and otherwise as desired for process use.

In the invented process, the stitch bind composition is applied to the stitched side of the tufted backing. It is applied to substantially the entire stitched side so that it contacts all or at least a substantial portion of the stitches. The stitch bind composition is applied in an amount such that sufficient organic polymer is delivered to the stitches so that on heating to remove the liquid of the binder, effective bonding of filaments of the stitches by the organic polymer component or its residue is achieved. Surprisingly low levels of the organic polymer component or its residue provide significant bonding of filaments and, frequently, increased tuft bind strength. Further increases in tuft bind strength often are achieved at higher levels. Particular amounts for a given application will vary somewhat depending on choice of the stitch bind composition and characteristics and composition of the components of the tufted backing. Generally, greater amounts of organic polymer give better results when face yarns of the tufted backing have greater yarn deniers or tighter or more compact structure, such as in cabled and twisted yarns, those with low bulk levels and with relatively small and tight yarn bundles often found in wool carpet face yarns. Greater amounts also are beneficial with tufting patterns having higher numbers of stitches per unit area or complex stitch patterns such as the stepover stitches commonly used in patterned and multi-level pile constructions.

Preferred amounts of organic polymer useful for a wide range of stitch bind compositions over a broad spectrum of carpet and face yarn choices are about 0.2 to about 3 osy, with about 0.3 to about 1.5 osy being preferred for typical velvet and plush carpet styles with face yarns having yarn deniers up to about 5000 and about 0.5 to about 2 osy preferred for heavier yarns and in carpet constructions with high stitch levels, stitch patterns with significant stepovers or overlap of stitches or otherwise having significant amounts of face yarn present on the stitched side of the tufted backing. It will be appreciated that the amounts of organic polymer component described above are expressed in weights of solid polymer applied to the stitched side of backings and that amounts of stitch bind composition applied to stitched sides of backings to provide such amounts of organic polymer and application rates will be determined based on organic polymer contents of the compositions and relevant process parameters such as the particular technique by which the composition is applied and line speeds.

The stitch bind composition can be applied to the stitched backing surface by any means suitable for effective application. Examples include application by spraying, as a froth or foam and with kiss roll or dip bath systems. The application system should be configured in relation to line speeds and widths and characteristics of the stitch bind composition to deliver the composition at rates effective to achieve the application amounts described above. For preferred stitch bind compositions having viscosities of about 1 to about 400 cps, application by spraying is convenient and provides good control over amounts applied. Spraying is conveniently accomplished using one or more spray nozzles configured to deliver a spray of effective volumes of the composition to the stitched side of a tufted backing. Most preferably, the stitch bind composition is sprayed from one or more nozzles disposed across the width of the carpet manufacturing line with the spray directed downward toward the stitched side of the tufted backing as it advances horizontally through the process line. Spray patterns are most preferably overlapped to account for typical reductions in volume and increasingly diffuse delivery of spray as distance from the center of the patterns increases.

After application of the stitch bind composition, but before softened resin of the thermoplastic binder solidifies in contact with the stitched side of the tufted backing, the stitched side with the liquid composition applied thereto is heated to remove the liquid component. This heating can take place in the same step as heating to soften the resin of the thermoplastic binder if desired or it can be conducted in a separate step. Heating is conducted at a temperature and for a time effective to drive off the liquid component of the stitch bind composition without damaging the tufted backing. Such damage can include melting or undesirable softening of the backing or face yarns, loss of face yarn bulk, development of a crispy or harsh texture in the face yarn tufts and curling, loss of strength or other undesirable effects on backings. Preferably, heating to remove the liquid component is such that the tufted backing does not reach temperatures higher than about 10° C. below the thermal damage temperature of the backing and face yarn, and more preferably at about 20° C. or more below such temperature. As will be appreciated, depending on the nature of the heating means employed and product characteristics, temperature settings of heating devices may exceed the temperature at which a particular tufted backing is damaged because factors such as heat transfer or dwell time in the device are such that damage to the tufted backing does not occur even at the higher temperature setting.

Specific temperatures and times for heating to remove the liquid component will depend on particular choices of materials and on equipment capabilities and configuration. For manufacture of carpets from commonly used materials of construction, heating is preferably conducted such that temperature of the tufted backing does not exceed about 150° C. and is more preferably about 140° C. Dwell times at the heating temperatures depend on temperature, nature and heat transfer capabilities of the heating means and mass of the carpet to be heated, and typically range from several seconds to several minutes. For carpets made from common materials of construction, aqueous stitch bind compositions in which polymer contents are about 5 to about 60 wt % and heating using circulating air ovens of the type generally employed in carpet manufacture, dwell times of about 0.2 to about 5 minutes are generally adequate for removal of liquid component. When heating to remove the liquid component and heating to soften the resin of a thermoplastic binder are conducted in the same step, temperatures and/or dwell times to soften the resin are typically adequate or more than adequate for removal of the liquid component.

As described above, the steps of applying stitch bind composition to a stitched side of a tufted backing and heating to remove the liquid component of the composition can be conducted as part of or in conjunction with manufacture of carpets using thermoplastic binders in which stitches of face yarn are anchored to a backing or between backings by cooling a softened thermoplastic resin in contact with a tufted backing surface or between backings to solidify the softened resin. Preferred carpet manufacturing processes using thermoplastic binders include as basic steps providing a tufted backing; contacting a stitched side of the tufted backing with a thermoplastic binder that comprises a thermoplastic resin capable of being softened in contact with the tufted backing, or of being softened and then contacted with the tufted backing, without damaging the tufted backing; heating the thermoplastic binder to soften the thermoplastic resin without damaging the tufted backing; and cooling the thermoplastic binder with the softened resin thereof in contact with at least the stitched side of the tufted backing to solidify the thermoplastic resin. Such steps are described in greater detail below.

One step comprises providing a tufted backing. The tufted backing comprises a backing and has a pile side and an opposite stitched side. The backing can be a single structure or it can be a composite comprising two or more individual backings or components. The pile side of the tufted backing is made up of tufts of face yarn that comprises a plurality of filaments. The stitched side has a plurality of stitches of the face yarn. The tufted backing can be provided by any suitable means. It can be made in a separate operation and provided to the process as a pre-formed structure, for example from rolls or other suitable sources of supply. Alternatively, formation of a tufted backing can be integrated with other steps so that the tufted backing is formed in-line and fed directly to one or more other steps. When pre-formed, the tufted backings are most conveniently provided from a roll.

Whether formed in a separate step or in-line, tufted backings are most commonly formed by advancing a backing through a tufting machine. Tufting machines typically have a plurality of reciprocating needles disposed so that they can be inserted into and retracted from a backing across its width as it advances through the machine. In use, the needles are threaded with face yarn and their reciprocating action together with advancement of the backing causes the needles to continuously penetrate through and out of the backing along the length thereof. The yarns with which the needles are threaded penetrate through and out of the backing, thereby forming a plurality of tufts on one side of the backing and a plurality of stitches on the opposite side. Tufts can be cut, typically by action of cutting blades acting in association with the tufting needles, to form so-called cut-pile carpets, or they can be left uncut to form so-called loop pile carpets. Needle spacing, distance of the needle stroke and speed of the backing through the machine can be varied to provide desired levels of tuft or pile density and pile height. Complex and patterned pile surfaces can be formed through use of different yarns, variations in needles, needle patterns or tufting parameters or other suitable means as known to those skilled in the tufting arts.

The backing used to form the tufted backing can include or incorporate a thermoplastic binder if desired. Thus, the backing can include or have needled, thermally bonded or otherwise secured to at least one surface thereof fibers or a fibrous assembly, such as a nonwoven web or loosely woven scrim, comprising a thermoplastic resin that softens or melts at a lower temperature than that at which the tufted backing is damaged by heat. Binder can also be included or incorporated in the backing to be tufted by coating or laminating to one or both backing surfaces a layer comprising such a thermoplastic resin. Such backings are best suited for use in manufacture of carpets in which the backing of the tufted backing is the only backing included in the carpets or in which an additional backing is secured to the stitched side of a tufted backing with thermoplastic binder in addition to that incorporated into the tufted backing.

The tufted backing can also be subjected to various intermediate finishing steps before use in the invented process. As noted above, tufts can be cut to form a cut pile. When face yarn of the tufted backing lacks desired coloration, as is often the case with nylon yarns, piece dying or continuous dying of the tufted backing can be conducted. Other examples include topical treatments with or applications of stain resisting agents, mold and mildew preventatives and combinations thereof. Generally, any such intermediate treatments can be performed provided they do not introduce into the tufted backing materials that will not withstand temperatures encountered during subsequent contact between the tufted backing and the softened resin of the thermoplastic binder. As with manufacture of the tufted backing, intermediate finishing steps can be performed separately from the invented process or they can be integrated into the same.

In embodiments of such processes in which preparation of a tufted backing is conducted in a separate operation from softening and cooling the resin of the thermoplastic binder, stitch bind composition can be applied and the liquid component removed therefrom as part of or in conjunction with preparation of the tufted backing. In such cases, the tufted backing provided to subsequent operations involving heating a thermoplastic binder and cooling softened resin thereof to solidify the same is a tufted backing having filaments of a plurality of the stitches thereof adhered with an organic polymer component or residue thereof.

Another step of processes using thermoplastic binders comprises contacting the stitched side of the tufted backing with a thermoplastic binder comprising a thermoplastic resin capable of being softened in contact with the tufted backing, or of being softened and then contacted with the tufted backing, without damaging the tufted backing. Contact can be accomplished by any suitable means, in a separate step or in the same step as other process steps, and with the binder in any suitable form, including solid form, with the resin of the binder softened or melted or combinations thereof. Contacting the stitched side of the tufted backing with the binder can occur at any of the structure on the stitched side of the backing, for example at one or more of the surfaces thereof formed by the stitches, between the backing and the backs of the stitches and between stitches.

In greater detail, the binder can be contacted with the stitched side of the tufted backing in solid form, such as a powder, pellets, granules or flakes of a thermoplastic resin formulation, fibers comprising the thermoplastic resin, nonwoven fabrics, scrims and other fibrous assemblies comprising filaments of resin formulation, films or sheets comprising the thermoplastic resin, layers or coatings comprising thermoplastic resin coated onto or applied to a backing or stitched side of a tufted backing, and fibers or any of the aforementioned fibrous assemblies secured to a backing such as by needling, thermal bonding, with adhesives or by other suitable means. It will be appreciated that when thermoplastic binder is incorporated into a backing that is subsequently tufted, contacting the binder and the stitched side occurs on tufting of the backing. The binder can also be contacted with the stitched side with the thermoplastic resin of the binder in softened or melted form, such as by extruding, coating or otherwise applying softened or melted resin to the backing or spinning melted or softened fibers directly onto a backing. Binders in more than one form and/or of one or more composition can be used.

With the wide range of forms in which the thermoplastic binder can be used, it will be appreciated that a wide range of techniques can be used for contacting the stitched side of the tufted backing with a binder. While any suitable technique can be used, preferred contacting techniques for binder in any particular form are those adapted to the form of the binder in a way that facilitates or promotes contact between softened resin of the binder and the stitched side of the backing. More preferably, the contacting technique is one that facilitates or promotes such contact such that softened resin contacts the stitched side in a substantially uniform manner relative to the entire stitched surface or at least a substantial portion of its area. Binder in particulate form, e.g., powder, pellets, flake, granules, can be contacted with stitched sides of backings by depositing the same onto stitched surfaces or otherwise applying the binder from suitable solids feeding equipment such as hoppers or other dispensers suitably positioned in relation to the tufted backing. Loose fiber can be sprinkled, spun or otherwise deposited onto stitched surfaces, with combs or other spreading devices used as may be desired or needed to aid in distribution of the fibers. Liquids can be used to aid in applying binders in the form of particulates or fiber, for example by forming pastes or slurries of binder that are spread onto backings. In such cases, the liquid should be one that is easily removed, such as by heating at temperatures below that at which the tufted backing is damaged; liquids used as the liquid component of the stitch bind composition are preferred. Binders in the form of film, sheet, fabrics or other fibrous assemblies can be fed into contact with the tufted backing from rolls, moving belt conveying systems or other sources of supply. As discussed above, binders in the form of coatings, layers, fibers or fibrous assemblies can be included or incorporated into backings to be tufted before tufting thereof, into additional backings when the same are used, or into both. Such composites of backings and binders can have the binder disposed on one or both surfaces of the backing. Thermoplastic binders with resin in softened or melted form can be extruded, coated, spun as filaments or otherwise applied to stitched surfaces or other backings.

Contacting a thermoplastic binder and the stitched side can be conducted at any stage of the process prior to cooling the softened resin of the thermoplastic binder to solidify the resin. As discussed above, such contact can be affected during tufting if the binder is included in a backing to be tufted or incorporated into such a backing before tufting. Binder in other forms can be contacted before, after or both before and after application of the stitch bind composition and before, after or both before and after heating to remove the liquid component thereof. When binder is applied to the stitched side of the backing with the resin of the binder in softened form, contacting the binder and the stitched side takes place after heating to at least soften the resin of the binder. When using binders that are applied to the stitched side with the resin of the binder in solid form, contacting takes place before heating the binder to soften the resin thereof. When combinations of binders in different forms or of different compositions are used, they can be contacted with the stitched side of the tufted backing in the same or separate steps. Contacting the binder with the stitched side is most preferably conducted so that the presence of binder in contact with the stitched side will not adversely affect application of stitch bind composition in contact with the stitches. To this end, contacting the thermoplastic binder and the stitched side of a tufted backing during tufting or after application of stitch bind composition are especially preferred. When used to secure tuft stitches and to bond additional backings to the stitched side of the tufted backing, the thermoplastic binder, tufted backing and additional backing are contacted in the same or separate operations to form an intermediate structure in which binder is disposed between the stitched side of the tufted backing and the surface of the additional backing to be secured thereto.

The thermoplastic binder is used in an amount effective to secure the tuft stitches in the final carpet structure and, if also used for bonding of additional backings, to secure the same to the stitched side of the tufted backing. Specific amounts will vary depending on factors such as form of the binder and manner in which it is applied, composition and flow properties of the resin of the binder, face yarn characteristics, carpet style and properties. Preferably, the binder is used in amounts effective to provide at least about 1 ounce of resin per square yard of area of the stitched side of the tufted backing because lesser amounts may provide insufficient resin for adequate bonding or be difficult to apply in a manner conducive to good distribution of softened or melted resin in contact with the stitched side of the backing. More preferably, the amount of binder is such as to provide about 2 to about 15 osy to promote good contact, distribution of softened resin and bonding without use of amounts so large that they can increase weight or reduce flexibility of final carpet structures and thereby limit installation benefits otherwise attainable. Most preferably, thermoplastic binder is used in an amount providing about 3 to about 12 ounces of thermoplastic resin per square yard of carpet to achieve desirable tuft bind and lamination of additional backings while also ensuring other benefits of the thermoplastic binder.

Another step of the carpet manufacturing processes in which application of stitch bind composition and heating to remove the liquid component thereof are employed comprises heating a thermoplastic binder to soften a thermoplastic resin component thereof without damaging the tufted backing. As noted above, the term "soften" is used to mean heat softening or melting of the resin. Although a subsequent step of such processes involves cooling the binder with the resin thereof in softened form in contact with the stitched side of the tufted backing to solidify the resin, it will be understood from the preceding description that heating to soften the resin of the binder can be conducted with or without the binder and the stitched side in contact—that is, before or after contacting the binder and the stitched side. Thus, heating to soften the resin of the thermoplastic binder can be conducted by heating the binder in contact with the stitched side of the backing, as where binder in the form of a powder, loose fiber, fabric, film, coating on a backing or other solid is applied or brought into contact with the stitched side of the tufted backing or is part of or added to a backing to be tufted. Alternatively, the binder can be softened before being brought into contact with the stitched side of the tufted backing, as when binder with softened resin is extruded, spun or coated onto the stitched side of the tufted backing or into contact with the stitched side and an additional backing.

Heating to soften the resin of the binder is conducted at a temperature equal to or above the softening point of the resin and without damaging the components of the tufted backing. Preferably, heating is such that temperature of the tufted backing as a result of the heating, or of its contact with softened resin of a previously heated binder, does not exceed a temperature about 10° C. less than that at which the tufted backing is damaged, and more preferably about 20° C. less, to provide a safety margin against such damage. For manufacture of carpets in which the backing and face yarn are composed of thermoplastic resins, heating to soften the binder preferably is such that temperature of the tufted backing does not exceed a temperature about 15° C. below the melting point of the lowest melting resin of such face yarn and backing. For carpets made from commonly used materials of construction, heating is preferably such that the temperature of the tufted backing does not exceed about 150° C. Heating times generally range from several seconds to several minutes, with more specific times varying with heating temperatures, composition of the binder and tufted backing, manner of contacting and equipment configuration, capabilities and operation. For common carpet materials, when thermoplastic binders in solid form and comprising preferred resins as described herein are contacted with a tufted backing, or with a tufted backing and an additional backing, and then heated to soften the resin of the binder, heating times of about 0.3 to about 8 minutes are preferred when heating is conducted using circulating air ovens or other heating devices with similar heat transfer capabilities. Particular times for specific combinations of materials, equipment configurations and other variables can be easily determined by routine experimentation guided by the description provided herein.

Heating to soften the resin of the binder can be conducted by any suitable technique. When such heating precedes contacting the binder and the stitched side of the tufted backing, it is most conveniently accomplished using an extruder. When such heating is conducted with the binder and the stitched side in contact, heating in a circulating air oven, by passage over heated rolls, or with electric or infrared heaters are examples of suitable techniques.

Another step of the processes in which application and heating of the stitch bind composition according to this invention are conducted comprises cooling the thermoplastic binder with the resin thereof in softened form in contact with the stitched side of the tufted backing to solidify the resin. Although considerable variation is possible in the sequence of other steps of the process, cooling to solidify softened resin of the binder is completed last among the steps of providing a tufted backing, contacting the backing and thermoplastic binder, heating the binder to soften the resin thereof and cooling to solidify the resin.

The result of the cooling step is to convert the softened resin of the binder to solid form in contact with a plurality of the stitches or the stitches and the backing surface on the stitched side of the tufted backing, thereby anchoring tufts to the backing within the final carpet structure. When an additional backing is to be laminated to the stitched side of the tufted backing, the binder with softened resin disposed between the stitched side of the tufted backing and a surface of the additional backing is cooled and the solidified resin of the binder serves to anchor the tufts and to secure the additional backing to the tufted backing at the stitched side thereof.

Cooling occurs at a temperature below the softening temperature of the thermoplastic resin of the binder; in this particular context the term "softening temperature" refers to the temperature at which the resin changes from a heat softened or plastified state to a solid. Cooling times vary depending on factors such as choice of resin of the thermoplastic binder, temperature of the softened binder resin, method of cooling and equipment configuration. In general, cooling takes place for at least long enough that the resulting cooled structure can be handled, for example by winding onto a roll, or subjected to further processing without flow or irreversible deformation of the resin. Cooling generally takes place over a period of several seconds to several minutes. Conveniently, cooling is accomplished by simply exposing the backing or backings in contact with softened or melted binder to ambient conditions, for example by passing the same out of or away from a heat source. Other cooling techniques, such as circulating cool air or passage of the structure into a zone, or over rolls, maintained at a desired cooling temperature are also suitable.

In manufacture of carpets from backings that can undergo shrinkage as a result of heat exposures encountered during contact with the softened resin of the thermoplastic binder, it is preferred to apply tension to the intermediate carpet structure during all or part of the heating and cooling steps. Tension is preferably applied in the cross direction—that is, perpendicular to the direction of advancement of the structure through the process line, also referred to as the machine direction—or in both the machine and cross directions. Forces conventionally applied to prevent shrinkage during heating and cooling of carpets or backings for other purposes are suitable in the invented process and are known to persons skilled in the art. Tension in the cross direction is conveniently applied using a tenter frame or other suitable widthwise stretching device. Machine direction tension can be applied by adjusting equipment drives for advancement of the intermediate carpet to and from cooling so that the latter is slightly faster.

While not required, when the softened resin of the thermoplastic binder is in contact with the stitched side of the tufted backing, or with that surface and a surface of an additional backing, application of force to the so-contacted materials can be beneficial to improve distribution of the resin within the structure and, on cooling to solidify the resin, encapsulation of tufts and bonding to the backing or backings. When such contact occurs with the pile surface of the tufted backing disposed downward, gravity alone can be an effective force. Other convenient means for application of force include passing the tufted backing, or the tufted and additional backings, in contact with the softened resin of the binder between rolls or over a roll under tension. Preferably, force of about 5 to about 100 pounds per linear inch is applied to promote this distribution while guarding against damage to face yarn tufts.

As described previously and evident from the foregoing description of processes using thermoplastic binders, the invented process is capable of considerable variation in many respects. It can be conducted continuously or discontinuously, with the former being generally preferred for its greater efficiency. The tufted backing can be prepared in a discrete operation conducted separately from the process or tufting can be integrated with the process. Stitch bind composition can be applied to a tufted backing and the result heated to remove the liquid component in one operation or location and the resulting tufted backing with filaments of a plurality of its stitches bonded by the organic polymer or residue thereof taken up on rolls and subsequently used with thermoplastic binders in completely discrete operations or locations. Alternatively, the tufted backing can be prepared and fed in-line to downstream processing. Stitch bind composition can be applied to the stitched side of the backing at any point in the process after tufting a backing but before the softened resin of the thermoplastic binder is solidified in contact with the stitched side. Also as described above, the thermoplastic binder can be applied in solid form or with the resin of the binder softened. Backing-thermoplastic binder composites can be prepared, or binders otherwise applied to or incorporated into backings before tufting thereof, such as by coating a backing or affixing binder fibers or fabric thereto in advance of tufting. The binder can also be applied to the tufted backing after tufting. One or more additional backing structures can be used in the process, with the same being laminated to the tufted backing, included as part of the tufted backing, or both. Binder can be applied to or incorporated into backings that are not tufted but are laminated to the tufted backing or otherwise incorporated into the carpet structure. Heating to remove the liquid component and heating to soften the resin of the thermoplastic binder can be conducted in the same or different steps. Preferably, application of the stitch bind composition and heating to remove the liquid component thereof are conducted before cooling of the softened resin of the thermoplastic binder so that vaporized liquid component does not interfere with cooling of the resin or become entrapped or create voids in the solidified resin. When using thermoplastic binders that are applied to the tufted backing in solid form with subsequent softening of the resin of the binder in contact with the stitched side of the backing, it is most preferred to apply the stitch bind composition to the stitched side and remove the liquid component before softening the resin of the thermoplastic binder. When using thermoplastic binders that are contacted with the stitched side with the resin of the binder in softened form, it is most preferred to apply the stitch bind composition to the stitched side and heat the structure to remove the liquid component before application of the thermoplastic binder. Intermediate or finishing steps can also be included in the processes; examples include dying and washing of intermediate or finished carpets, cutting of looped tufts and application of topical treatments for stain, mold, mildew resistance or other improved properties and taking up carpets in finished form. Persons skilled in the art will appreciate that other variations and modifications of the process can be made without departing from the scope of the invention.

It also will be appreciated that a wide range of materials is suitable for use in the invented process. The stitch bind composition and components thereof are described above. Other materials include backings, face yarn and thermoplastic binder.

Any suitable backing can be used for or included in the tufted backing. A wide range of backings for carpets is well known. They are generally flat or sheet-like, tuftable materials with flexibility and integrity suited for process manipulations and sufficient strength and tuftability to allow penetration by needles and face yarn during tufting while retaining strength and integrity for carpet performance. Backings can be constructed in any suitable manner and from any suitable materials for attaining desired performance characteristics. Examples include woven, knitted and nonwoven fabrics, films, sheets and composite structures having one of more of the above combined with one or more others or with other materials such as scrims and netlike nonwoven fabrics. Preferred materials of construction for the backing comprise thermoplastic resins due to their desirable combination of cost and properties. Examples include polyolefins, such as polypropylene, polyethylene (low, linear low, medium or high density or so-called metallocene polyethylenes), copolymers of ethylene or propylene with each other and/or other monomers, nylons, polyesters and blends comprising such resins. Backings constructed from paper, natural materials such as jute and hemp, and other non-thermoplastic materials also can be used although they do not afford the potential melt reprocessing benefits of thermoplastic backings.

Woven polypropylene fabrics, and particularly those woven from tapes, also referred to as slit film or ribbon yarns, are most commonly used for such backings owing to their superior combination of cost, tuftability, and properties such as strength, durability, mold and mildew resistance. An example is Polybac® Fabric which is a woven polypropylene primary backing made and sold in a wide range of styles by Amoco Fabrics and Fibers Company.

Preferred woven backings for the tufted backing are flat fabrics woven from tapes in a plain weave with an average of about 10 to about 32 yarns per inch in each of the warp and weft directions. Tape dimensions generally vary from about 30 to about 125 mils wide and about 1 to about 3 mils thick; tape deniers generally range from about 300 to about 1500. Particularly preferred primary backings are plain weave fabrics woven from polypropylene tapes with about 18 to about 28 warp tapes per inch and about 8 to about 18 weft tapes per inch wherein the warp tapes are about 1.3 to about 2 mils thick and about 30 to about 60 mils wide and the weft tapes are about 1.7 to about 2.3 mils thick and about 80 to about 120 mils wide. Tapes can be contoured or uncontoured. Contoured tapes can provide particular advantages when woven into a backing and coated with a lower melting thermoplastic resin to stabilize the weave and facilitate tufting by preventing shifting of tapes due to impingement of tufting needles. Coated backings woven from contoured tapes are disclosed in commonly assigned U.S. Pat. No. 5,925,434. The lower melting point of the coating resin also makes such coatings suitable as thermoplastic binders or as components thereof. Fibrillated tapes can also be included in backings to be tufted.

Preferred nonwoven backings are generally relatively dense mats or webs of continuous filaments or staple fibers. The filaments or fibers commonly comprise polyester or polyolefin resins, such as polyethylene terephthalate and polypropylene, respectively. Polyester is generally preferred for nonwoven backings due to its greater heat stability and greater resistance to shrinkage. An example of a known polyester nonwoven backing is Lutradur® fabric. Nonwoven backings can also be composed of higher and lower softening point fibers or filaments, such that thermoplastic binder is thereby incorporated into the backings. Nonwoven backings also can be calendered or needled to improve their integrity, dimensional stability or other properties. Nonwoven backings generally have basis weights in the range of 3 to about 6 osy with filament deniers generally ranging from about 3 to about 20. Although nonwoven backings are generally less dimensionally stable than woven backings, and therefore less commonly used in many conventional carpet applications, use of the stitch bind composition and thermoplastic binder with tufted nonwoven backings according to this invention can provide improvements that expand potential utility of the backings.

As additional backings useful according to the invention, whether used in preparation of the tufted backing, laminated to the stitched side of the tufted backing or in other ways, any suitable backing can also be used. Generally, any of the backings described above can be used as an additional backing, including the aforementioned films, woven, knitted and nonwoven goods and composite materials. In addition, scrims, netlike nonwovens and the like can be used or laminated to such other structures to provide high levels of dimensional stability and/or improved tuftlock. Preferred additional backings are materials constructed of thermoplastic resins, and particularly polypropylene tapes and/or yarns. While woven, nonwoven and knitted fabrics are most commonly used, particularly preferred additional backings are conventional polypropylene secondary backing fabrics which are typically woven from polypropylene tapes, or from such tapes in one direction and polypropylene filament or spun yarns in a perpendicular direction. Plain weave and leno constructions are preferred. Secondary backings used in carpets with conventional latex binders are often constructed in an open weave to promote uptake of binder by the backings. While such open weave backings are useful in the invented process, flow properties of the thermoplastic binders used according to the invented process are such that close weave constructions are also well suited.

For use in the invented process, especially preferred additional backings are fabrics woven from polypropylene tapes, and especially those with such tapes in the warp and polypropylene spun or multifilament weft yarns, in a plain or leno weave construction with about 10 to about 24 warp tapes per inch and about 4 to about 14 weft tapes or yarns per inch. Specific examples of such secondary backings are ActionBac® Fabrics available from Amoco.

As discussed above and described below in connection with the thermoplastic binders used according to the processes to which the invention relates, it also is contemplated to include or incorporate one or more thermoplastic binders in a backing, including the backing or backings to be tufted, additional backings, or both. Composite backings having a binder attached or affixed to a backing are suitable as are backings in which the binder is directly included or incorporated into the backing, such as in the case of backings constructed from tapes or yarns comprising higher and lower softening point resins.

Face yarns suitable as components of the tufted backings used according to the invented process also are well known and can be composed of any suitable material. The yarns comprise a plurality of filaments. Preferably, filaments comprise at least one thermoplastic resin; examples include nylon, polyester, polypropylene or acrylic resins. Continuous filament yarns and spun yarns are suitable. Natural fiber yarns, such as those in which the filaments are wool or cotton also are contemplated although they do not afford the melt reprocessing benefits of yarns with thermoplastic filaments. Continuous filament yarns used for carpet face yarn are usually bulked to provide texture resembling natural fiber yarns. Bulking is introduced by various techniques such as crimping, texturing with fluid jets, twisting and detwisting and the like. Twisting, cabling, plying, heatsetting and combinations of such techniques are often used to impart or preserve bulk in such yarns. Such bulked continuous filament yarns are commonly referred to as "BCF" yarns. Nylon BCF yarns, composed of either nylon 66 or nylon 6, are most commonly used in carpets although polypropylene BCF yarns are also widely used, as are nylon spun yarns and polyester yarns. All are well suited for use in the present invention. Pigmented, or so-called solution-dyed yarns, prepared by incorporating pigments into the resin from which filaments are melt spun, are suitable as are natural color yarns that are dyed after tufting, for example as part of a finishing step during carpet manufacture. Generally, BCF face yarns have linear densities of at least about 1200. Deniers up to about 10,000 are common in most conventional carpet styles although in some styles, such as Berbers, yarn deniers as high as 20,000 and even greater are known. Filament counts of typical face yarns range from about 70 to about 1200, with about 8 to about 30 denier per filament.

Thermoplastic binders used for bonding of backings and anchoring tufts to or between backings are also well known and can be provided in a wide range of forms and from a wide range of materials, as described above. The binder comprises a thermoplastic resin that is capable of being softened in contact with the tufted backing and additional backings that may be used, or of being softened and then contacted with the tufted backing and additional backings if used, without damaging the tufted backing or the additional backing. Thus, the resin is one that can exist in a softened state in contact with the tufted backing, or with the tufted backing and additional backing or backings, at a temperature that does not damage such other components. For thermoplastic binders that are contacted with tufted backings or tufted backings and additional backings before heating to soften the resin of the binder, softening temperature of the resin of the binder is below the temperature at which the backings are damaged by heat. For binders contacted with backings with the resin of the binder already in a softened state, resin softening points can exceed temperatures at which the backings are damaged provided that contacting of the binder and the backing or backings does not damage the backing or backings, for example as a result of cooling that inherently occurs as an extruded film or filament of resin passes from a die to a substrate and/or when it contacts a lower temperature substrate or a roll at a lower temperature. Preferred binder resins are those that can be heat-softened or melted, or can be contacted in a heat softened or melted state with a tufted backing and additional backings if used, at a temperature at least about 10° C. below the lowest temperature at which backings and face yarns are damaged by heat, and more preferably at least about 20° C. below such temperature.

Preferred binder resins also exhibit sufficient flow or formability when softened or melted so that they flow around or encapsulate the tuft stitches and/or the junctions of the stitches with the backing. The resins also should have sufficient cohesive strength that, on cooling, solid resin encapsulates or coats the tufts and adheres tufts to additional backings with sufficient strength and integrity to anchor the tufts and provide a good bond between the stitched side of the tufted backing and any additional backing laminated thereto. For use with backings and face yarns composed of thermoplastic resins, particularly preferred resins of the thermoplastic binder are those in which the onset of softening occurs at temperatures about 10° C. or more below the lowest softening-onset temperature of the thermoplastic resins of the other components, and more preferably at about 15 to about 30° C. below such temperature because these temperatures are high enough to allow a wide range of candidate resins for the binders when using backings and face yarns that are commonly used in carpets, but also low enough that heating to soften the resin can easily be accomplished without damage to backings and face yarns. In general, when using polypropylene backings and face yarns composed of nylon, polypropylene, polyester or natural fibers, preferred resins for the thermoplastic binder soften at temperatures of about 100 to about 150° C.

As described above, the thermoplastic binder preferably is used in a form that facilitates contact of the stitched side of the tufted backing with softened resin of the binder so that the softened resin is or can be distributed in substantially uniform weights per unit area in contact with the stitched side. It will be understood that the distribution of resin in contact with the stitched side can be continuous or discontinuous. As described above, the binder can be used in a variety of solid forms, including by way of example, pellets, powder, flake, or other particulates, loose fibers or fibrous assemblies such as webs, scrims or grids and woven or nonwoven fabrics, films, sheets and coatings. The binder can also be present in or incorporated into backings as in backing-binder composites or otherwise, for example by bonding a fibrous web, nonwoven fabric or loose fibers to a surface of a backing by needling, thermal bonding, with adhesives or by other suitable means. The binder can also be in the form of a coating, film or layer disposed on at least one surface of a backing. In any of these cases, the backing or composite into which the binder is incorporated or in which it is present or to which it is adhered can be a backing from which the tufted backing is formed or it can be an additional backing that is laminated or otherwise affixed to the tufted backing. The binder can also be provided in the form of a melt or softened resin as when resin is extruded or otherwise applied in a heat softened state to a backing surface. As noted above, binders in the form of film, sheet, fabric or coating, and those applied as a softened or melted layer or film, are advantageous because they are in a form that is well matched to process operations and facilitate substantially uniform application of binders to backings. Binders of the same or different form and composition can be used in combination. As an example, use of a primary backing with needled binder fibers or fabric as a backing to be tufted and a secondary backing with a layer or coating of binder bonded thereto can be used with good results. Use of combinations of binders in different forms and/or with different thermoplastic resins is also contemplated and can allow tailoring components of binders to elements of carpet structure, style or components, for example to match resin melt viscosities to backing constructions or resin compositions or polarities to backing or face yarn compositions.

In the case of binders in the form of fibers, continuous or discontinuous fibers are suitable, with the latter generally being better suited to process use and more uniform application to stitched sides of backings. For discontinuous fibers, fibers of any suitable length and diameter can be used. Lengths up to about 8 inches are preferred because longer fibers can be difficult to apply. Combinations of fibers with different dimensions can be used to promote more even distribution of binder resin on softening thereof and, in turn, more uniform and consistent bonding on cooling of the resin. Loose fibers can be supplied to the stitched side of a tufted backing from a hopper or other suitable dispenser. Fibers also can be needled to backings to be tufted or to additional backings to be laminated to the stitched side of a tufted backing. Also as described above, when one or more backings used according to the process is a nonwoven backing, thermoplastic binder in the form of fibers can be incorporated directly into the backings by using the fibers in combination with other fibers from which the backings are made. The resulting backings thus comprise a combination of higher softening and lower softening fibers.

Binders in the form of powder, flakes or particulates comprising thermoplastic resin can be of any suitable dimensions and configuration for use in the process. As with loose fiber, binder in the form of powder, flake or particulates can be applied from a hopper or other suitable solid feeding device. Binders in such form can also be slurried in liquids or formed into a paste to facilitate application. Also as with loose fibers, application of combinations of different particle sizes can contribute to more uniform distribution of binder in contact with stitched or other backing surfaces and bonding on cooling of the binder to bond carpet components.

Nonwoven fabrics, or webs, suitable for use as thermoplastic binders according to the invention include both continuous filament nonwovens, such as spunbonded and centrifugally spun fabrics, and fabrics comprising discontinuous or staple fibers, such as carded staple fiber webs, needlepunched nonwovens, hydroentangled webs and the like. Melt blown webs of continuous or discontinuous fibers can also be used, as can other fibrous assemblies such as woven fibers, scrims and needlepunched fibers. Filaments or fibers of these materials can be of any suitable dimensions, with deniers of about 0.1 to about 20 being particularly well suited. Fabrics and webs can be used in weights corresponding to desired application rates and can be conveniently provided to the process from rolls, provided in-line from manufacture thereof or by other suitable means. Preferred fibrous assemblies are nonwoven, continuous filament webs and staple fiber webs, and particularly those having basis weights of about 1 to about 12 osy. Such webs having sufficient strength and integrity that they can be easily and conveniently handled for use in the process and having sufficient uniformity of coverage as to aid in achieving good distribution of softened resin on heating are more preferred, both for use in the process as freestanding webs and in composites with backings. Centrifugally spun continuous filament webs, spunbonded webs and needlepunched staple fiber nonwoven fabrics or webs with such properties are especially preferred.

In the case of binders provided in combination with, or as part of, one or more backings used in the process, the composites and combinations can also be provided in a wide range of forms. As noted above, binder in the form of a layer can be coated or laminated to one or more backing surfaces, binder in the form of fibers or fibrous assemblies can be affixed to one or more backings or binder in the form of fibers can be included in nonwoven backings. In greater detail, binders in the form of a layer applied to a backing can be disposed continuously or discontinuously over the backing and to one or both surfaces thereof. Continuous layers are preferred for better distribution of softened resin. Layer thickness will depend on nature of the backing and composition of the resin of the binder and can be selected with reference to the weight of resin to be used. Preferably, layer thicknesses do not exceed about ¼ inch because thicker layers may make tufting or other handling of backings more difficult. Backings having binder in the form of fibers or fabrics affixed thereto can be prepared by any suitable means. Needling of binder in such form to backings can be advantageous because needling typically results in presence of fibers on both surfaces of backings. When presence of the fibrous binder on only one surface of a backing is desired, thermal or adhesive bonding of the fibers to the backing surface is preferred. Binder fibers can also be included in the fibers or yarns from which backings are made and bicomponent fibers and yarns containing higher and lower softening point resins can be used to form backings.

Binders supplied in the form of softened resin are typically extruded directly onto stitched backing surfaces or between the same and another backing as the same are brought together. Resin can be extruded from a suitably configured and dimensioned die. Other suitable means for applying binder with the resin thereof in melted form include spinning and melt blowing fibers of softened resin directly onto backing surfaces.

Suitable resins of the thermoplastic binder are thermoplastic resins that soften in relation to temperatures at which other carpet components are damaged as described above. In addition, the resins soften above about 50° C. because lower softening point resins may not withstand temperatures encountered in storage and use of finished carpets. Preferred resins have flow properties that are conducive to flow or formability of softened or melted resin in contact with backings and encapsulation of stitches. Particularly preferred resins for use with common carpet materials, such as polypropylene backings and nylon, polyester and polypropylene face yarns, soften at temperatures up to about 190° C., provided that in the case of thermoplastic binders that are contacted with a tufted backing before heating to soften the resin of the binder, softening points are up to about 150° C. Such resins preferably have flow properties at such temperatures corresponding to MIs of about 1 to about 200 g/10 min., more preferably from about 2 to about 150 g/10 min., and most preferably from about 5 to about 100 g/10 min. Based on the examples described below, the resins can consist entirely or essentially of thermoplastic polyethylene resins having flow properties corresponding to an MI of about 2.2 to about 105 g/10 min. as measured in accordance with ASTM D 1238; and a viscosity between approximately 230,000 and 4,881,000 cps at about 270° F. with a shear rate of about 10 $sec^{-1}$ as measured in accordance with ASTM D 3835.

As previously described, preferred compositions of the resins are polyethylenes, ethylene-propylene copolymers and blends containing the same due to their beneficial combination of softening points well suited to use with common backing and face yarn materials, good flow properties or deformability when melted or softened, and suitable cohesive strength for good bonding of stitches and lamination of secondary backings if used. For carpets with nylon face yarns, thermoplastic binders comprising resins with polar functionality or resins modified by addition of such functional groups, and especially hydroxyl, carboxyl or amide functionality, can provide enhanced bonding to face yarns as a result of interaction between the functional groups of the binder resin and the amide linkages of the nylon. Examples of resins having polar functionality include ethylene-acrylic acid copolymers, maleated polypropylenes and maleated styrene-butadiene and styrene-ethylene-butylene copolymers.

The thermoplastic binder can consist entirely or essentially of one or more thermoplastic resins or it can contain one or more resins in combination with additives and modifiers if desired; examples include pigments and colorants, flow aids, flame retardants, antimicrobials, stabilizers and process aids, fillers and extenders. Binders consisting entirely or essentially of thermoplastic resin are preferred for maximizing resin content of the binders.

Another embodiment of the invention provides carpets, including carpets made by the invented process and carpets with features of construction that can provide improved performance in use.

Carpets prepared according to the invented process are advantageous over conventional carpets in a number of respects. When thermoplastic backings and face yarns are employed, trim and waste generated in their manufacture can be used in melt reprocessing operations. As a result, manufacture of carpets according to the invention can be performed with improved efficiency in materials usage. Manufacture of carpets according to the invented process also eliminates need for preparation and handling of latex formulations. Further, for a given carpet style in terms of tufting pattern and gauge, pile height and face yarn type, carpets made according to the invented process can be made in lighter weights than conventional carpets and are more flexible and more easily manipulated in process operations as well as subsequent handling and installation. Other advantages of carpets according to the invention are described above.

While carpets made according to the invented process represent an aspect of the invention, the invention also provides carpets that are considered novel and improved over known carpets by their structure, or their structure and properties, but without regard to the particular manner in which they are made. While the invented process represents a preferred method for making such improved carpets, carpets with the improved features according to this aspect of the invention are considered a part of the invention without regard to any particular method of manufacture.

Carpets according to this aspect of the invention comprise a backing, face yarn, organic polymer component and a thermoplastic binder that is substantially free of crosslinked polymer solids and inorganic particulates. These components are associated such that the face yarn penetrates the backing such that a plurality of tufts of the face yarn project from a surface of the backing and a plurality of face yarn stitches are disposed on an opposite surface of the backing, filaments of a plurality of stitches are bonded by the organic polymer component, and a plurality of stitches are bonded to the backing with the thermoplastic binder. In another embodiment, carpets according to the invention further comprise a secondary backing that is bonded to the stitched side of the backing described above with the thermoplastic binder. The carpets preferably contain less than 3 osy crosslinked polymer solids, and more preferably less than about 2 osy of such crosslinked solids, exclusive of species such as the gel particles and crosslinked particles or domains that may result from melt processing aids noted above.

In greater detail, penetration of the backing by face yarns in the invented carpets is as described above with respect to the tufted backings used in or provided to the invented process. Tufts are further secured within the carpets by the thermoplastic binder which is distributed continuously or discontinuously in contact with the stitches of the backing and encapsulates all or part of the stitches, and may also contact the backing, to anchor or lock the tufts within the carpet structure. Preferably, the binder is present in the finished carpet so that it is distributed within the carpet at substantially uniform amounts per unit area of the carpets. The thermoplastic binder is present in an amount effective to bond tuft stitches within the carpet and to bond to the stitched side of the tufted backing any additional backing that may be laminated thereto with the binder. Preferably, carpets contain about 2–15 osy of thermoplastic binder because lesser amounts may provide insufficient bonding and greater amounts can increase stiffness and weight. More preferably, about 3 to about 10 osy thermoplastic binder is present.

The carpets also comprise an organic polymer component bonded to filaments of the stitches. The organic polymer component of the carpet normally is present in discontinuous form and preferably in the form of small, discrete domains bonded at least to filaments of the stitches and usually also to the backing surface, the thermoplastic binder or both. The organic polymer component of the invented carpets comprises an organic polymer or residue of the type described above in connection with the invented process. Accordingly, the organic polymer component of the carpets can comprise an organic polymer that is the same as organic polymers of the type described above in connection with the stitch bind compositions used in the invented process or it can comprise a reaction product of such a polymer or of such a polymer with other components. The organic polymer component bonds filaments of the stitches so that filaments of the face yarn tufts are more securely held in the carpet structure. Preferred carpets according to the invention contain about 0.2 to about 3 osy of organic polymer component, a substantial portion of which is adhered to filaments of the stitches. More preferably, the organic polymer content of carpets is about 0.3 to about 2 osy.

The invented carpets are composed of other materials as described above in reference to the invented process. Preferred backings are woven polypropylene fabrics. Preferred face yarns comprise nylon, polypropylene and polyester filaments. Preferred thermoplastic binders comprise the polyethylenes, copolymers and blends as described above.

The carpets can be provided in styles, weights, tuft densities and pile heights as desired. Tufted carpets can be provided in a broad range of styles and weights. Examples of the former include Saxony, Berber, velvet, cut-and-loop, cut pile, high-low, and loop pile carpets. Cut pile styles are frequently used for residential carpet applications while loop pile styles are typically used for commercial, hospitality and carpet tile applications. Weights typically range from about 10 to about 80 osy, with about 14 to about 45 osy being preferred for commercial carpets and about 12 to about 65 osy for residential carpets. Pile heights of about ⅜ to about ⅞ inch are common in residential carpets while about 3/16 to about ½ inch are common of commercial carpets. Tuft densities typically range from about 20 to about 300 needle penetrations per square inch for both types of carpets. While these constructions are typical of the types of carpets currently used in various applications, it will be appreciated by those skilled in the art that heavier and lighter weights, longer or shorter pile heights and greater or lesser tuft densities also can be suitable for various end uses and are contemplated for the invented carpets. Other things being equal, the invented carpets are lighter in weight than carpets made using conventional aqueous latexes because the relatively high filler loadings found in the latter are not used in the invented carpets.

Carpets according to this aspect of the invention preferably have improved fuzz resistance, and often have improved tuft bind strength as compared to comparable carpets lacking the organic polymer component. More preferably, the carpets have Fuzz Ratings determined according to the examples appearing below, and reported on the 11 point scale used therein, of 4 or lower, and more preferably of 2 or lower. Tuft bind strengths of the carpets preferably are at least about 2 pounds in cut pile carpets and at least about 5 pounds in loop pile carpets. More preferably, cut pile carpets have tuft bind strengths of at least 3 pounds and loop pile carpets have tuft bind strengths of at least about 6.25 pounds. The invented carpets also are resistant to water uptake and consequently retain their fuzz resistance and tuft bind strength even when used in environments in which contact with water occurs.

The following examples illustrate the invention. They are not to be considered limiting.

In the examples, Fuzz Ratings of loop pile carpets were determined using a test generally referred to as the Velcro Roller test. The test is commonly, though not universally, recognized in the carpet industry. It is not considered useful for testing cut pile carpets because the test device used does not cause adequate fuzzing of cut pile tufts for meaningful evaluation. The test uses a two pound, three inch wide, two inch diameter cylindrical steel roller equipped with a handle and covered with the hook portion of Velcro® brand tape. The roller is manually rolled back and forth over a section of carpet about six inches long for a total of twenty passes, ten in each direction. Fuzz Rating is determined by visual observation of filaments on the Velcro covered roll. Ratings sometimes use a 5 point scale and sometimes an 11 point scale. In the following examples, and otherwise for purposes of the invention, the 11 point scale is used. Fuzz levels corresponding to ratings on the two scales are generally as follows:

| Filaments on Roll | Rating (5 Point Scale) | Rating (11 Point Scale) |
|---|---|---|
| None | 1 | 0 |
| Extremely low | 1 | 1–2 |
| Very low-slight fuzzing | 2 | 3–4 |
| Low-moderate fuzzing | 3 | 5–6 |
| Medium-considerable fuzzing | 4 | 7–8 |
| High-severe fuzzing | 5 | 9–10 |

Carpets displaying no, extremely low, or very low fuzzing are generally considered acceptable. U.S. Pat. No. 3,684,600 presents a similar ranking scale.

Tuft Bind strengths reported in the examples were determined according to ASTM D1335.

EXAMPLE 1

A tufted carpet is prepared on a carpet line as illustrated in the drawing operated at a line speed of 50 feet per minute (15 m/min). The tufted backing has a 152 inch wide primary backing woven from polypropylene tapes in a plain weave construction with 24 warp tapes per inch by 15 weft tapes per inch. The primary backing is tufted in a straight stitch pattern with 4000 denier, cabled, heatset nylon BCF face yarn to form a cut pile with 8 stitches per inch on the stitched side, ⅛ gauge and face yarn weight of 42 osy.

The stitch bind composition is a 15 wt % solids content, 3.3 cps, aqueous dispersion of solid ethylene acrylic acid copolymer prepared by diluting a commercially available ethylene acrylic acid copolymer dispersion in ammonia water, designated MichemPrime 4983-30R. The dispersion, before dilution, has nominal polymer solids content of 30 wt %, viscosity of 1000 cps and its ethylene-acrylic acid copolymer has nominal acrylic acid unit content of 20 wt % and melt index of 300 g/10 min. The dispersion is sprayed onto the stitched side of the tufted backing at 3.3 osy, corresponding to 0.5 osy dry weight of the ethylene acrylic acid copolymer, using a spray applicator system having 20 spray heads positioned at intervals of about eight inches across the width of the line and about 12 inches above the tufted backing. Spray is delivered under pressure of about 30 psig in the form of a curtain of droplets in a fan pattern about 12 inches wide at the surface of the stitched side and with about half of the width of the spray from each nozzle overlapped by spray from each of its adjacent nozzles.

After application of the dispersion, the tufted backing with the dispersion applied thereto is passed into a forced air oven with air temperature maintained at 280° F. (138° C.). At the line speed utilized, dwell time in the oven is one minute.

A composite of a secondary backing and thermoplastic binder is unwound from a roll and supplied into contact with the tufted backing. The backing-binder composite has a 6.5 mil thick, 4.5 osy layer of binder coated on a surface of a woven secondary backing. The coating is composed of a linear low density polyethylene, with nominal MI of 27 g/10 min, density of 0.941 g/cc and melting point of 125° C., identified as Aspun 6811A from Dow. The coating was applied by extrusion coating a 6.5 mil thick layer of the polyethylene resin onto a secondary backing fabric, identified as ActionBac Style 3865 from Amoco, woven from polypropylene warp tapes and polypropylene spun yarns in the weft in a 16×5 leno weave construction. The coated secondary backing is contacted with the stitched side of the tufted primary backing so that the coating contacts the stitched side of the tufted backing. The resulting intermediate structure advances into a forced air oven set at 300° F. (149° C.). At the line speed used, dwell time in the oven is 2½ minutes, which is sufficient to melt the resin of the coating on the secondary backing fabric.

The intermediate structure with melted resin of the binder passes from the oven into the nip between two steel rolls at ambient temperature. The rolls are located within about three feet from the oven so that the resin is still melted when the structure reaches the nip. A force of 30 pounds per linear inch is applied at the nip. The carpet is then taken up on a roll, with the takeup located about 40 feet from the nip. The resin of the binder cools to solid form during advancement of the structure away from the nip roll pair to the takeup.

The resulting cut pile carpet has a construction and properties, including tuft bind strength and fuzz resistance, suitable for use in many typical residential carpet applications.

EXAMPLE 2

A tufted carpet is prepared on a carpet line as illustrated in the drawing operated at a line speed of 30 feet per minute (9 m/min).

The tufted backing has a primary backing fabric as in Example 1 to which had been needled a thermoplastic binder in the form of a 3 osy continuous filament nonwoven fabric prepared according to U.S. Pat. No. 5,173,356. The filaments of the nonwoven fabric were composed of a linear low density polyethylene resin having nominal MI of 105 g/10 min, density of 0.930 g/cc and melting point of 125° C. The nonwoven fabric is needled to the primary backing with 400 needle punches per square inch such that a web is disposed on one side of the backing and a plurality of filaments from the web penetrate to the other side of the backing.

The primary backing with affixed binder is tufted in a stepover stitch pattern with 5000 denier nylon BCF face yarn to form a ¼ inch high, loop pile with 8 stitches per inch and ⅛ gauge. Pile weight is 28 osy. The backing-binder composite is tufted so that the pile extends from the side of the composite having a plurality of filaments from the web and the stitches are disposed on the web side of the composite.

Stitch bind composition as used in Example 1 is sprayed onto the stitched side of the resulting tufted backing using the spray system as in Example 1 at an application rate of 6.7 osy, corresponding to 1.0 osy dry weight of polymer.

After application of the dispersion, the tufted backing with the dispersion applied thereto is passed into an oven as in Example 1 set at 260° F. (127° C.). At the line speed utilized, dwell time in the oven is 2 minutes.

A secondary backing—thermoplastic binder composite as in Example 1 is unwound from a roll and advanced into contact with the stitched side of the tufted backing so that the coating contacts the stitched side.

The resulting intermediate structure is advanced into an oven as in Example 1 set at 300° F. (149° C.). At the line speed used, dwell time in the oven is 3.1 minutes, which is sufficient to melt the resin of the filaments of the web needled to the primary backing fabric and the coating on the secondary backing fabric.

The intermediate structure with melted resin of the binders passes from the oven to the nip roll pair configured as in Example 1 and through the nip where it is subjected to force of 30 pounds per linear inch. The result is then cooled and the finished carpet is wound onto a roll.

The resulting loop pile carpet has excellent tuft bind and fuzz resistance properties and is constructed in a style representative of typical commercial carpets such as are used in office buildings, airports, retail stores and showrooms.

EXAMPLES 3–37

In the following examples, carpet samples were prepared from various materials and Fuzz Ratings of loop pile samples and Tuft Bind strengths of all samples were determined. Carpet samples were made according to the following general procedure.

Tufted primary backings with various face yarns and primary backing fabrics, as described in detail in connection with the specific examples in which they were used, were prepared on a laboratory scale tufting machine or obtained from commercial sources. Additional backings, or composites thereof with thermoplastic binders, were also used, again as described in connection with specific examples in which they were used.

Samples of tufted primary backings and of additional backings or additional backing—thermoplastic binder composites were cut into rectangles 18 inches long and 12 inches wide, with the longer dimension in the machine direction. Stitch bind compositions in the form of aqueous dispersions or emulsions were prepared by diluting various commercially available materials with water to 10–15 wt % solids or polymer contents. The materials from which the stitch bind compositions were prepared and their solids or polymer contents and viscosities as used are described in detail in Table I. The dispersions were sprayed in a fine mist onto the stitched sides of tufted backing samples using a household garden sprayer. Spray was applied to substantially all of the stitches of the stitched sides until estimated polymer contents reached desired levels. Immediately after spraying, the wet, tufted backings were placed stitched side up in a Hix 021 Infra-Air Conveyer Dryer that had been preheated to 220° F. (104° C.). The samples were removed from the oven after 10 to 12 minutes. Samples removed from the oven were dry and filaments of the stitches were bonded with polymer from the stitch bind composition or a residue thereof.

Following drying, the tufted backings with bonded filaments and an additional backing or additional backing—binder composite were placed together onto the pins of a 12 inch by 18 inch tenter frame. When using additional backing—thermoplastic binder composites, the tufted backing and composites were brought together so that the composite surface formed by the binder was in contact with the stitched side of the tufted backing. The resulting structures were then passed, pile side down, through the Conveyer Dryer set at 290° F. (143° C.) for a dwell time of about 6 minutes. During passage through the dryer, the resin of the binder melted. Immediately after the 6 minute dwell time, the structure, with the resin still melted, was removed from the tenter frame and passed between two smooth steel rolls with a force applied at the nip. In examples using nylon or polyester face yarns, force at the nip was 73 pounds per linear inch. In examples using polypropylene face yarns, force at the nip was 10 to 15 pounds per linear inch.

Materials from which the stitch bind compositions were prepared and polymer contents and viscosities of the compositions as used in the examples are shown in the following table.

TABLE I

| Binder No. | Composition | Tradename or Source |
|---|---|---|
| 1 | 30 wt %, 1000 cps dispersion in ammonia water of ethylene acrylic acid copolymer (Primacor 5985 from Dow with nominal 20 wt % acrylic acid units; melt index of 300 g/10 min, molecular weight of 18000); as used, solids content was 10–15 wt % and viscosity was 3.3 cps | Michem-Prime 4983-30R |
| 2 | 52.5 wt %, 362 cps emulsion in water of carboxylated styrene-butadiene copolymer rubber with about 65 wt % bound styrene; as used, polymer content was 15 wt % and viscosity was 1.6 cps | Tylac 69809-00 |
| 3 | 25 wt %, 450 cps dispersion in water of maleated polypropylene resin with Tg of about 15° C. and nominal molecular weight of 80,000; as used, polymer content was 10 wt % and viscosity was 10.6 cps | Experimental product |
| 4 | 52 wt %, 200 cps emulsion in water of self crosslinking ethylene vinyl acetate copolymer with Tg of 10° C.; as used, polymer content was 10 wt % and viscosity was <10 cps | Elite-33 |
| 5 | 52 wt %, 100 cps emulsion in water of self-crosslinking, ethylene vinyl acetate copolymer with Tg of 0° C.; as used, polymer content was 10 wt % and viscosity was <10 cps | Dur-O-Set E-623 |
| 6 | 44 wt %, 150 cps emulsion in water of crosslinkable, carboxylated styrene acrylate copolymer with Tg of −6° C.; as used, polymer content was 10 wt % and viscosity was <10 cps | Rhoplex NW-1715K |
| 7 | 50 wt %, 352 cps emulsion in water of styrene-n-butyl acrylate copolymer with Tg of 25° C., believed to have about 50 wt % styrene units and about 50 wt % acrylate units; as used, polymer content was 15 wt % and viscosity was 1.5 cps | Acronal S728 |
| 8 | 51 wt %, 100 cps emulsion in water of acrylic polymer with Tg of −4° C.; as used, polymer content was 10 wt % and viscosity was <10 cps | Nacrylic X4280 |
| 9 | 49 wt %, 30 cps emulsion in water with synthetic anionic emulsifier of vinyl chloride-acrylic copolymer; as used, polymer content was 15 wt % and viscosity was <5 cps | BFGoodrich TN-2000 |
| 10 | 50 wt %, 615 cps emulsion in water, without plasticizers or solvents, of n-butyl acrylate/acrylonitrile/styrene copolymer with Tg of 4° C.; as used, polymer content was 10–15 wt % and viscosity at 15 wt % polymer content was 1.7 cps | Acronal S504 |

EXAMPLES 3–10

These examples illustrate carpets according to the invention prepared as described above from woven polypropylene backings and nylon face yarns, with about ½ osy organic polymer or residue and about 4–6 osy thermoplastic binder, in a loop pile construction.

Tufted backings were prepared from solution dyed, 2-ply, cabled, 3300 denier continuous filament nylon face yarn having 4.8 turns per inch and a primary backing fabric, identified as PolyBac Fabric Style 2261 from Amoco, woven from polypropylene tapes in a plain weave construction with 24 warp tapes per inch and 15 weft tapes per inch. The backing fabric was tufted with the face yarn in a straight stitch pattern and loop pile construction at ⅛ gauge, 8 stitches per inch and pile weight of 22 osy.

The additional backing was a 2.43 osy, plain weave secondary backing fabric woven from polypropylene warp tapes and 1800 denier polypropylene spun yarns in the weft direction in a 12×6 construction.

The thermoplastic binder was in the form of a layer of thermoplastic resin coated onto the additional backing. The resin was a linear low density polyethylene resin, identified as Aspun 6811A from Dow Chemical, having nominal MI of 27 g/10 min at 190° C., density of 0.941 g/cc and melting point of 125° C. The resin was extrusion coated onto the secondary backing fabric to form a continuous coating on the surface of the fabric. Coating was conducted on an extrusion coating line using a two inch diameter, single screw extruder with a twenty inch slot die having a die gap adjusted within the range of about 10 mils to provide different coating thicknesses and weights. The extruder was operated at screw speed settings of 50 rpm, barrel temperature settings of about 185° C. and die temperature setting of 200° C. The melted resin was extruded onto the fabric backing about two inches upstream from a stainless steel chill roll—rubber coated press roll combination with the chill roll maintained at 30° C. with circulating water. The coated fabric was passed to a nip between the rolls such that the coating contacted the chill roll. Force of about 50 pounds per linear inch was applied at the nip between the rolls. After solidification of the coating, the resulting secondary backing—thermoplastic binder composite was taken up on a roll located downstream of the nip roll pair.

Fuzz Ratings and Tuft Bind strengths with different stitch bind compositions, identified with reference to Table 1, as well as stitch bind polymer and thermoplastic binder contents of the samples, are reported in the following table.

TABLE 2

| | Stitch Bind Composition | | | | Tuft |
|---|---|---|---|---|---|
| Example | No. | Weight (osy) | Thermoplastic Binder (osy) | Fuzz Rating | Bind (lbs) |
| Control A | — | 0 | 4.9 | 10 | 2.3 |
| Control B | — | 0 | 4.2 | 9 | 2.0 |
| 3 | 1 | 0.57 | 5.0 | 0 | 6.1 |
| 4 | 3 | 0.61 | 4.6 | 1 | 5.1 |
| 5 | 10 | 0.54 | 5.4 | 1 | 2.7 |
| 6 | 7 | 0.58 | 5.0 | 2 | 4.6 |
| 7 | 2 | 0.52 | 4.9 | 1 | 4.2 |
| 8 | 4 | 0.51 | 5.4 | 1 | 3.3 |
| 9 | 8 | 0.52 | 5.5 | 3 | 2.7 |
| 10 | 5 | 0.50 | 5.3 | 3 | 2.6 |

As seen from these examples and the table, all of the samples prepared using the stitch bind compositions showed significant improvements in Fuzz Ratings as compared to the Controls. The good Fuzz Ratings were achieved even though the face yarn used in these examples was a twisted yarn with a compact structure that hinders good penetration into the interior of the yarn bundles making up the stitches. In addition, Tuft Bind strength increased significantly with some of the stitch bind compositions.

EXAMPLES 11–14

Example 3 was repeated except that the amount of stitch bind composition was varied. Results are reported in Table 3.

TABLE 3

| Example | Stitch Bind Composition No. | Weight (osy) | Thermoplastic Binder (osy) | Fuzz Rating | Tuft Bind (lbs) |
|---|---|---|---|---|---|
| Control A | — | 0 | 4.9 | 10 | 2.3 |
| 11 | 1 | 0.25 | 4.8 | 1–5* | 4.6 |
| 12 | 1 | 0.52 | 4.7 | 0 | 5.8 |
| 13 | 1 | 1.02 | 4.7 | 0 | 6.8 |
| 14 | 1 | 1.51 | 4.7 | 0 | 7.6 |

*Results varied for different areas of the sample; variability is believed to reflect inconsistent application of organic polymer component to the stitched backing at the level of polymer used in this example.

As seen from these examples and the table, in this carpet construction fuzz resistance at about ¼ osy was just acceptable or variable but at about ½ osy became superior. Tuft bind strengths also increased with increasing amounts of stitch bind polymer 1.

EXAMPLES 15–16

The procedure of Examples 3–10 was repeated except that the tufted backing had 2750 denier, nylon 6 continuous filament face yarns tufted into the primary backing fabric in a loop pile construction with ⅛ gauge, 8 stitches per inch, a straight stitch pattern and pile weight of 18 osy. Stitch bind composition No. 6, as described in Table 1, was used in varying amounts. Fuzz ratings and Tuft Bind strengths of the resulting samples are reported in the following table.

TABLE 4

| Example | Stitch Bind Composition No. | Weight (osy) | Thermoplastic Binder (osy) | Fuzz Rating | Tuft Bind (lbs) |
|---|---|---|---|---|---|
| Control C | — | 0 | 5.8 | 8 | 4.8 |
| 15 | 6 | 0.23 | 5.8 | 4 | 5.4 |
| 16 | 6 | 0.63 | 4.7 | 1 | 5.2 |

As seen from these examples and the table, in this carpet construction, fuzz resistance at about ¼ osy was acceptable but was significantly better at about ½ osy.

EXAMPLES 17–18

In these examples, carpet samples were prepared using stitch bind compositions 1 and 2 and materials otherwise the same as in Examples 3–10, except that before tufting the primary backing fabric was needled as in Example 2 with a thermoplastic binder in the form of a two-ply, 3 osy nonwoven fabric. The nonwoven fabric binder was prepared from a formulation containing 99 parts by weight of a linear low density polyethylene resin, identified as Aspun 6806A from Dow Chemical, having nominal MI of 105 g/10 min at 190° C. and melting point of 125° C., and one part by weight of a multiphase, thermoplastic elastomeric polypropylene-polyethylene copolymer, identified as Montell KS-057 having nominal MFR of 30 g/10 min at 230° C.

Stitch bind polymer and thermoplastic binder contents, Fuzz Ratings and Tuft Bind strengths of the resulting samples and of a control made without use of stitch bind composition are reported in Table 5. Thermoplastic binder amounts shown in the table are weight of binder coated on the secondary backing plus weight of nonwoven fabric needled to the primary backing.

TABLE 5

| Example | Stitch Bind Composition No. | Weight (osy) | Thermoplastic Binder (osy) | Fuzz Rating | Tuft Bind (lbs) |
|---|---|---|---|---|---|
| Control D | — | 0 | 7.8 | 9 | 2.9 |
| 17 | 1 | 0.47 | 7.7 | 0 | 7.2 |
| 18 | 2 | 0.51 | 7.7 | 0 | 4.9 |

Comparing Control D with Controls A and B, it can be seen that the additional 3 osy of thermoplastic binder used in these examples increased Tuft Bind strength but did not improve Fuzz Rating. Tuft Bind was further improved as a result of use of stitch bind compositions in Examples 17 and 18. From these results and those in Examples 3 and 7, in which the same stitch bind compositions were used, it also can be seen that the presence of the additional 3 osy of thermoplastic binder did not impair fuzz resistance imparted by the stitch bind composition. As in examples 3–10, these results are considered impressive in view of the compact nature of the twisted face yarn of the tufted backing.

EXAMPLES 19–21

These examples illustrate carpet according to the invention with cabled nylon BCF yarns tufted in a woven polypropylene backing in a multi-level loop pile construction with extreme stepover stitches. This style and these materials are representative of carpet tiles. Extreme stepover stitching as in this sample makes good fuzz resistance difficult to achieve.

Face yarns were a 2880 denier, cabled nylon BCF yarn, a 4150 denier nylon BCF yarn and a 2750 denier nylon BCF yarn. The face yarns were tufted into a primary backing fabric woven from polypropylene tapes in a plain weave construction. Face yarns were tufted in a multi-level, loop pile construction with a stepover stitch pattern at 1/10 gauge, 11 stitches per inch and pile weight of 24 osy. Tufting with the three different face yarn types produced a pile with a patterned effect.

Carpet samples prepared in these examples also included a secondary backing which was a fabric woven from polypropylene warp tapes and 1800 denier polypropylene spun yarn in the weft in a leno construction with 16 warp tapes per inch and 5 weft yarns per inch and nominal weight of 2.1 osy.

Thermoplastic binder was used in the form of a 9.5 mil thick coating on the secondary backing. The binder had the same composition and was applied to the secondary backing fabric as in Examples 3–10.

Stitch bind polymer and thermoplastic binder weights, Fuzz Ratings and Tuft Bind strengths of the resulting samples are reported in Table 6.

TABLE 6

| Example | Stitch Bind Composition No. | Weight (osy) | Thermoplastic Binder (osy) | Fuzz Rating | Tuft Bind (lbs) |
|---|---|---|---|---|---|
| Control E | — | 0 | 6.6 | 8 | 4.6 |
| 19 | 1 | 1.0 | 6.6 | 2 | 6.7 |
| 20 | 7 | 1.0 | 6.6 | 2 | 6.3 |
| 21 | 2 | 1.0 | 6.6 | 3 | 6.2 |

As seen from the table, in this carpet construction, use of the stitch bind composition resulted in significant improvements in Fuzz Ratings and Tuft Bind as compared to the control. These results are considered surprising in view of difficulties in achieving good fuzz resistance in carpet constructions of this type, as noted above.

EXAMPLES 22–27

These examples illustrate effectiveness of the invention in carpets tufted with polypropylene face yarn in a typical commercial carpet style.

Tufted backings were prepared with a loop pile and straight stitch pattern with 1/10 gauge, 10 stitches per inch and pile weight of 20 osy. Face yarn was 2750 denier, pigmented polypropylene BCF yarn. The face yarn was tufted into a primary backing fabric, identified as PolyBac Fabric Style 2205, of woven polypropylene tapes in a 24×13 plain weave construction.

These examples also used a secondary backing fabric-thermoplastic binder composite as in Examples 3–10.

Stitch bind polymer and thermoplastic binder weights, Fuzz Ratings and Tuft Bind strengths of the resulting samples are reported in Table 7.

TABLE 7

| Example | Stitch Bind Composition No. | Weight (osy) | Thermoplastic Binder (osy) | Fuzz Rating | Tuft Bind (lbs) |
|---|---|---|---|---|---|
| Control F | — | 0 | 4.2 | 8 | 3.7 |
| 22 | 1 | 0.59 | 4.5 | 3 | 7.7 |
| 23 | 3 | 0.49 | 4.2 | 1 | 8.1 |
| 24 | 4 | 0.51 | 4.2 | 3 | 5.7 |
| 25 | 8 | 0.51 | 4.4 | 3 | 3.4 |
| 26 | 10 | 0.57 | 4.2 | 2 | 8.1 |
| 27 | 6 | 0.57 | 4.1 | 5 | 4.4 |

As seen from these examples, all of the stitch bind compositions were effective in reducing fuzzing and all but one also increased tuft lock of this polypropylene face yarn-tufted carpet. Fuzz Ratings improved significantly in all cases except with the styrene-acrylate copolymer dispersion in Example 27.

EXAMPLES 28–30

These examples illustrate carpets according to the invention constructed in a Berber pattern. Berber patterns have significantly larger face yarn bundles than many other carpet styles, which typically is conducive to good Tuft Bind strength with thermoplastic binders but detrimental to fuzz resistance. Fuzz resistance of Berber carpets made with conventional latex binders is also difficult to achieve.

Face yarns used to prepare tufted backings were 16,800 denier, entangled, pigmented polypropylene BCF yarns. The backing was a primary backing fabric woven from polypropylene tapes in a 24×11 plain weave. The face yarn was tufted in a multilevel loop construction with a wiggle stitch pattern at ¼ gauge, 5.5 stitches per inch and 45 osy pile weight.

In these examples the secondary backing fabric-thermoplastic binder composite as in Examples 3–10 was also used.

Stitch bind polymer and thermoplastic binder weights, Fuzz Ratings and Tuft Bind strengths of the resulting samples are reported in Table 8.

TABLE 8

| Example | Stitch Bind Composition No. | Weight (osy) | Thermoplastic Binder (osy) | Fuzz Rating | Tuft Bind (lbs) |
|---|---|---|---|---|---|
| Control G | — | 0 | 5.0 | 10 | 10.0 |
| 28 | 1 | 1.0 | 5.0 | 4 | 16.1 |
| 29 | 7 | 1.5 | 5.0 | 4 | 17.1 |
| 30 | 9 | 1.5 | 5.0 | 6 | 14.8 |

As seen from the table, fuzz resistance increased in the Berber carpet samples according to the invention. Weights of stitch bind polymer in these samples exceeded those in most other examples due to the large yarn bundles, but were still minor relative to overall carpet weight and provided surprising improvements in Fuzz Ratings.

EXAMPLES 31–36

In these examples, carpets according to the invention were made with polyester face yarn in a cut pile construction representative of residential carpets.

Tufted backings were prepared from cabled, stuffer box-crimped, heat set, 2-ply polyester (polyethylene terephthalate) spun yarns with 4400 total denier and 5.5 turns per inch. The yarns were tufted into a woven primary backing fabric as used in Examples 22–27 in a cut pile construction with a stepover stitch, ⅛ gauge, 8 stitches per inch, pile height of ½ inch and pile weight of 40 osy. The secondary backing fabric-thermoplastic binder composite as in Examples 3–10 was also used. Stitch bind polymer contents, thermoplastic binder weights and Tuft Binds are reported in Table 9.

TABLE 9

| Example | Stitch Bind Composition No. | Weight (osy) | Thermoplastic Binder (osy) | Fuzz Rating | Tuft Bind (lbs) |
|---|---|---|---|---|---|
| Control H | — | 0 | 4.2 | — | 3.2 |
| 31 | 1 | 0.57 | 4.4 | — | 3.9 |
| 32 | 3 | 0.63 | 4.6 | — | 2.7 |
| 33 | 4 | 0.53 | 4.4 | — | 4.2 |
| 34 | 8 | 0.53 | 4.2 | — | 2.1 |
| 35 | 6 | 0.59 | 4.3 | — | 3.2 |
| 36 | 10 | 0.53 | 4.3 | — | 3.5 |

This example demonstrates results with this polyester face yarn-tufted carpet according to the invention. Fuzz Ratings were not obtained for these samples because the Velcro roller doesn't cause fuzzing suitable for evaluation on cut pile carpets. For an indication of fuzzing, samples were subjected to a non-standardized test known as the "coin rub test." In that test, a US quarter dollar coin was rubbed by hand back and forth for 5 seconds on a small area, about 2 inches by 2 inches, of the carpet samples and the amount of fuzz kicked up due to the rubbing was assessed. Although the test is poor for comparison of different samples because the intensity of rubbing is not standardized, coin rub test results for the samples made using the stitch bind composition generally indicated significantly better fuzz resistance than for the control.

EXAMPLE 37

In this example, a carpet according to the invention was prepared with wool face yarn.

The tufted backing had a woven primary backing fabric of polypropylene tapes in a 28×24 plain weave construction to which had been needled a thermoplastic binder in the form of a 4.5 osy continuous filament nonwoven fabric as in Examples 17–18. The primary backing—binder composite was tufted with a 2900 denier, 3 turns per inch twisted yarn spun from 80 wt % wool and 20 wt % nylon fiber in a cut pile, straight stitch pattern with 1/10 gauge, 10 stitches per inch and ¼ inch pile height.

Heating time to melt the resin of the thermoplastic binder was 8½ minutes in this example.

The secondary backing fabric-thermoplastic binder composite as in Examples 3–10 was also used. Nip force applied to the intermediate carpet with melted thermoplastic binder resin was 50 pounds per linear inch.

Stitch bind polymer contents, thermoplastic binder weights and Tuft Bind strengths of the resulting samples are reported in Table 10. Thermoplastic binder weights reported in the table are weights of coating on the secondary backing plus nonwoven fabric needled to the primary backing.

TABLE 10

| | Stitch Bind Composition | | | | Tuft |
|---|---|---|---|---|---|
| Example | No. | Weight (osy) | Thermoplastic Binder (osy) | Fuzz Rating | Bind (lbs) |
| Control I | — | 0 | 9.0 | — | 1.4 |
| 37 | 1 | 0.5 | 9.0 | — | 2.6 |

As seen from the table, Tuft Bind strength of the carpet sample according to the invention was almost double that of the control. However, the low Tuft Bind strengths for both the control and example as compared to other examples reflect the relatively small yarn bundle size of the face yarn used in this example and the fact that wool yarns are generally less conducive to bonding with thermoplastic binders than synthetic yarns. Coin rub test results indicated that fuzz resistance was better in the example than in the control.

EXAMPLE 38

A tufted backing was prepared in a cut pile construction, ⅛ gauge, with a stepover stitch pattern, 8 stitches per inch, pile height of ½ inch and pile weight of 42 osy, from a woven polypropylene primary backing as in Examples 22–27 and a 2-ply cabled nylon BCF yarn.

The tufted primary backing was passed pile side down to a 90 feet long carpet finishing oven preheated to 220° F. (104° C.) at a speed of 15 ft per minute. Just prior to entering the oven, the stitched side of the tufted primary backing was sprayed with a stitch bind composition as in Table 1, No. 1, except that polymer solids had been diluted to 10 wt % and viscosity was 2.2 cps. The spray was applied at a rate of about 5 osy. The treated backing was passed through the oven; residence time was about 6 minutes. The dried tufted backing had an average stitch bind polymer content of about 0.5 osy disposed as a discontinuous coating and agglomerates on and within the stitches on the stitched side such that filaments of most of the stitches were bonded.

The tufted backing with bonded filaments was then combined with a composite of a secondary backing as in Examples 3–10 that had been extrusion coated with a thermoplastic binder in the form of a 4.5 osy layer of the linear low density polyethylene resin used in Examples 3–10. The tufted backing and secondary backing—binder composite were brought together so that the binder contacted the stitched side of the tufted backing. The resulting intermediate structure was run pile side up through a 120 feet long, forced air oven at 30 feet per minute and oven air temperature of 335° F. (168° C.) Immediately after the carpet exited the oven, it was passed through a driven nip roll set where a nip force of 70 pounds per linear inch was applied. The carpet was allowed to cool for about 10 minutes and then was taken up on a roll. The finished carpet had an average Tuft Bind strength of 4.7 lbs and good fuzz resistance by the coin rub test.

For comparison, the procedure described above was repeated except the tufted backing was contacted with the secondary backing—binder composite without application of stitch bind dispersion or drying. The resulting finished carpet had a lower Tuft Bind strength (3.6 pounds) and was less resistant to fuzzing in the coin rub test than when the stitch bind composition was used.

EXAMPLE 39

Following the procedures, and using a tufted backing, stitch bind dispersion, spray applicator and oven as in Example 1, the dispersion is sprayed onto the stitches of the tufted backing and then dried in the oven. The resulting tufted backing has filaments of a plurality of its stitches bonded with about ½ osy ethylene acrylic acid copolymer in the form of a discontinuous coating on and penetrating into the stitches. The result is taken up on a roll.

In a separate operation, the tufted backing with adhered filaments is unwound and fed into contact with a secondary backing—thermoplastic binder composite as in Example 1. The resulting intermediate structure is advanced into an oven and heated as in Example 1 to melt the resin of the binder coated onto the secondary backing. The result, with the resin of the coating still melted, is advanced to a nip system as in Example 1, force of 30 pounds per linear inch is applied and the result is cooled and taken up.

The resulting carpet has properties similar to the carpet of Example 1.

EXAMPLE 40

A tufted backing as in Example 1 with stitch bind composition applied and dried as in that example is extrusion coated across the full width of its stitched side with a melted film of linear low density polyethylene resin having nominal MI of 27 g/10 min, density of 0.941 g/cc and melting point of 125° C. to form an 8.5 osy, 9.5 mil thick layer of the resin coated onto the tufted backing. Extrusion coating is conducted using single screw extruder with a slot die and operated at screw speed of 59 rpm, extruder barrel temperature setting of 185° C., die temperature of 200° C. and die gap of 10 mils. The melted resin is coated onto the tufted backing about two inches upstream from a stainless steel chill roll—rubber coated press roll combination with the chill roll maintained at 30° C. with circulating water. The coated structure advances into the nip between the rolls such that the coating contacts the chill roll and the pile side contacts the press roll. Force of 50 pounds per linear inch is applied at the nip between the rolls to press the melted resin into the stitched side without compressing the tufts making up the pile surface. The coating cools to solidify the resin shortly downstream of the roll pair and is taken up.

The resulting carpet has good fuzz resistance and tuft bind strength. Comparable results are attained when a secondary backing in the form of a 16×5 leno weave fabric of polypropylene warp tapes and polypropylene spun weft yarns is unwound from a roll and advanced into the nip between the press roll and the chill roll so that it contacts the melted resin extruded onto the tufted backing at the nip.

EXAMPLE 41

A tufted primary backing as in Example 1 is sprayed with stitch bind composition according to Table 1, No. 1, and then dried in a forced air oven as in Example 1. The amount of organic polymer in the dried product is about ½ osy. The dried, tufted backing having filaments of a plurality of its stitches bonded with the organic polymer is taken up on a roll.

In a separate operation, the tufted backing with bonded filaments is unwound and passed pile side down through an oven with infrared heaters positioned about 12 inches above the surface of the stitched side. A uniform coating of low density polyethylene powder with density of 0.92 g/cc, MI of 3 g/10 min and melting point of 108° C. is sprinkled onto the stitched side as the tufted backing passes through the oven. The amount of polyethylene powder is 5 osy. The belt speed and power to the heaters are adjusted so that the polyethylene powder melts and reaches a temperature of 270° F. Immediately prior to exiting the oven, a woven secondary backing as in Example 40 is advanced into contact with the stitched side of the tufted primary backing with the polyethylene powder still melted. The resulting laminate of melted resin disposed between the secondary backing and the stitched side of the tufted primary backing is passed out of the oven to and through a pair of steel nip rolls that apply a force of 30 pounds per linear inch. The result is allowed to cool for about four minutes and is then taken up on a roll. The resulting carpet has properties similar to the carpet of Example 1.

We claim:

1. In a process for manufacture of tufted carpets comprising steps that comprise adhering to a stitched side of a tufted primary backing a plurality of stitches of face yarn comprising a plurality of filaments by applying a thermoplastic binder comprising a softened or melted thermoplastic resin into contact with the stitched side by (a) extruding the binder with melted thermoplastic resin into contact with the stitched side or (b) heating the binder applied or present in solid form in contact with the stitched side to soften or melt the thermoplastic resin, and cooling the thermoplastic binder in contact with the stitched side to solidify the resin, the improvement wherein the thermoplastic binder consists entirely or essentially of a thermoplastic polyethylene having flow properties corresponding to an MI of about 2.2 to about 105 g/10 min. as measured in accordance with ASTM D 1238; and a viscosity between approximately 230,000 and 4,881,000 cps at about 270° F. with a shear rate of about 10 $sec^{-1}$ as measured in accordance with ASTM D 3835, and comprising steps that comprise applying to a plurality of the stitches, before the resin solidifies, a stitch bind composition having a viscosity effective for coating or penetrating the stitches to contact the filaments thereof ranging from about 0.5 to 2900 cps and comprising an aqueous liquid component that boils or vaporizes at a temperature such that it can be removed by heating below a temperature at which the tufted backing is damaged by heat and an organic polymer component that bonds filaments of the stitches on removal of the aqueous liquid component, wherein the stitch bind composition is applied in an amount effective to provide about 0.2 to about 3 ounces of the organic polymer component or a residue thereof per square yard of the stitched side; and, after applying the stitch bind composition but before the resin solidifies, heating the stitch bind composition to substantially remove the aqueous liquid component without damaging the tufted backing.

2. The process of claim 1 wherein the stitch bind composition is a solution, suspension or emulsion comprising the organic polymer component and the liquid component.

3. The process of claim 1 wherein organic polymer content of the stitch bind composition is about 5 to about 60 wt % of the composition.

4. The process of claim 1 wherein the stitch bind composition has a viscosity of about 1 to 1200 cps.

5. The process of claim 1 wherein the softened or melted thermoplastic resin applied into contact with the stitched side of the tufted primary backing has flow properties corresponding to an MI of about 5 to about 100 g/10 min.

6. The process of claim 1 wherein the stitch bind composition is applied to the stitched side of the tufted backing as a spray.

7. The process of claim 1 wherein the stitch bind composition is applied to the stitched side of the tufted backing as a foam.

8. The process of claim 1 wherein the stitch bind composition is applied to the stitched side of the tufted backing as a froth.

9. The process of claim 1 wherein the tufted backing comprises a woven polypropylene fabric tufted with face yarn.

10. The process of claim 9 wherein the face yarn comprises nylon filaments.

11. The process of claim 9 wherein the face yarn comprises polyester filaments.

12. The process of claim 9 wherein the face yarn comprises polypropylene filaments.

13. The process of claim 1 wherein the stitch bind composition has a viscosity of about 1.5 to 400 cps.

14. The process of claim 1 wherein the organic polymer component comprises a film-forming organic polymer.

15. The process of claim 1 wherein the organic polymer component comprises a thermoplastic polymer.

16. The process of claim 1 wherein the organic polymer component comprises a crosslinkable organic polymer.

17. The process of claim 16 wherein the stitch bind composition comprises a crosslinking agent for the organic polymer.

18. The process of claim 1 wherein the organic polymer component comprises an olefin-unsaturated acid, olefin-unsaturated acid ester or olefin-diene copolymer.

19. The process of claim 18 wherein the organic polymer component comprises an ethylene acrylic acid copolymer.

20. The process of claim 18 wherein the organic polymer component comprises a styrene acrylate copolymer.

21. The process of claim 18 wherein the organic polymer component comprises a carboxylated styrene butadiene copolymer.

22. The process of claim 1 wherein cooling the softened or melted resin in contact with the tufted backing is conducted with the softened or melted resin also in contact with an additional backing.

23. A process for manufacture of carpets comprising the steps of providing a tufted backing having a stitched side that has a plurality of stitches of face yarn comprising filaments, wherein filaments of a plurality of the stitches are bonded with a stitch bind composition comprising an organic polymer which is present at about 0.2 to about 3 ounces per square yard of the stitched side, the stitch bind composition having a viscosity effective for coating or penetrating the stitches to contact the filaments thereof ranging from about 0.5 to 2900 cps and comprising an aqueous liquid component contacting the stitched side of the tufted backing with a thermoplastic binder that consists entirely or essentially of a thermoplastic polyethylene having flow properties corresponding to an MI of about 2.2 to about 105 g/10 min. as measured in accordance with ASTM D 1238; and a viscosity between approximately 230,000 and 4,881,000 cps at about 270° F. with a shear rate of about 10 $sec^{-1}$ as measured in accordance with ASTM D 3835 and that softens or melts at a temperature below a temperature at which the tufted backing is damaged by heat or that, when softened or melted, can contact the tufted backing without such damage; heating the thermoplastic binder to soften or melt the resin without damaging the tufted backing; and cooling the backing with softened or melted resin in contact with the stitched side to solidify the resin.

24. In a process for making carpets that comprises steps comprising:

providing a tufted backing comprising a backing and having a pile side and an opposite stitched side, wherein the pile side has a plurality of tufts of face yarn that comprise a plurality of filaments and the stitched side has a plurality of stitches of the face yarn;

contacting the stitched side of the tufted backing with a thermoplastic binder that comprises a thermoplastic resin that softens or melts at a temperature below a temperature at which the tufted backing is damaged by heat or that, when softened or melted, can contact the tufted backing without such damage, wherein the binder is applied into contact with the stitched side by (a) extruding the binder with melted thermoplastic resin into contact with the stitched side or (b) heating the binder applied or present in solid form as a film, fiber, fabric, particulates or combination thereof in contact with the stitched side to soften or melt the thermoplastic resin, without damaging the tufted backing; and cooling the thermoplastic binder with the softened or melted resin thereof in contact with at least the stitched side of the tufted backing to solidify the thermoplastic resin;

the improvement wherein the thermoplastic binder consists entirely or essentially of a thermoplastic polyethylene resin having flow properties corresponding to an MI of about 2.2 to about 105 g/10 min. as measured in accordance with ASTM D 1238, and a viscosity between approximately 230,000 and 4,881,000 cps at about 270° F. with a shear rate of about 10 $sec^{-1}$ as measured in accordance with ASTM D 3835, and comprising steps that comprise:

applying to a plurality of stitches, before the softened or melted resin solidifies, a stitch bind composition that has a viscosity effective for coating or penetrating the stitches to contact the filaments thereof ranging from about 0.5 to 2900 cps and comprises an aqueous liquid component that boils or vaporizes at a temperature such that it can be removed by heating below a temperature at which the tufted backing is damaged by heat and an organic polymer component that bonds filaments of the stitches on removal of the aqueous liquid component, wherein the stitch bind composition is applied in an amount effective to provide about 0.2 to about 3 ounces of the organic polymer component or a residue thereof per square yard of the stitched side; and after applying the stitch bind composition but before the softened or melted resin solidifies, heating the stitch bind composition to remove the aqueous liquid component without damaging the tufted backing.

25. A process for making carpets comprising steps that comprise:

adhering to a stitched side of a tufted backing a plurality of stitches of face yarn comprising a plurality of filaments by cooling in contact with the stitched side a thermoplastic binder consisting entirely or essentially of a softened or melted thermoplastic polyethylene resin having flow properties corresponding to an MI of about 2.2 to about 105 g/10 min. as measured in accordance with ASTM D 1238; and a viscosity between proximately 230,000 and 4,881,000 cps at about 270° F. with a shear rate of about 10 $sec^{-1}$ as measured in accordance with ASTM D 3835 to solidify the resin, wherein the thermoplastic binder with the thermoplastic resin thereof in softened or melted form is contacted with the stitched side by heating the thermoplastic binder applied or present in solid form as a nonwoven fabric of continuous or staple fibers consisting entirely or essentially of the thermoplastic resin and having a weight of about 1 to about 15 ounces per square yard in contact with the stitched side to soften or melt the thermoplastic resin;

applying to a plurality of stitches, before the resin solidifies, a stitch bind composition having a viscosity effective for coating or penetrating the stitches to contact the filaments thereof ranging from about 0.5 to 2900 cps and comprising an aqueous liquid component that boils or vaporizes at a temperature such that it can be removed by heating below a temperature at which the tufted backing is damaged by heat and an organic polymer component that bonds filaments of the stitches on removal of the aqueous liquid component, wherein the stitch bind composition is applied in an amount effective to provide about 0.2 to about 3 ounces of the organic polymer component or a residue thereof per square yard of the stitched side; and heating the stitch bind composition, after application thereof to the stitches and before the resin solidifies, to remove the aqueous liquid component of the stitch bind composition.

26. A process for making a tufted carpet comprising steps that comprise providing a tufted backing comprising a backing, face yarn comprising a plurality of filaments, and a thermoplastic binder in the form of a coating, fabric or fibers consisting entirely or essentially of solid thermoplastic polyethylene resin that softens or melts at a temperature below a temperature at which the backing and face yarn are damaged by heat and has flow properties corresponding to an MI of about 2.2 to about 105 g/10 min. as measured in accordance with ASTM D 1238; and a viscosity between approximately 230,000 and 4,881,000 cps at about 270° F. with a shear rate of about 10 $sec^{-1}$ as measured in accordance with ASTM D 3835, wherein face yarn penetrates the backing and forms a pile surface comprising a plurality of tufts on one side of the backing and a plurality of stitches on an opposite, stitched side of the backing, and the thermoplastic binder is present on at least the stitched side of the backing;

applying to the stitched side of the tufted backing and in contact with a plurality of the stitches a stitch bind composition having a viscosity effective for coating or penetrating the stitches to contact the filaments thereof ranging from about 0.5 to 2900 cps and comprising water and an organic polymer component that bonds filaments of the stitches on removal of the water, wherein the stitch bind composition is applied in an amount effective to provide about 0.2 to about 3 ounces of the organic polymer component or a residue thereof per square yard of the stitched side;

heating the tufted backing in contact with the stitch bind composition to remove the water without damaging the tufted backing;

heating the binder to soften or melt the thermoplastic resin without damaging the tufted backing; and cooling the binder with the softened or melted resin thereof in contact with the stitched side of the tufted backing to solidify the resin.

27. A process for manufacturing carpets comprising steps that comprise providing a tufted primary backing having a pile side comprising face yarn tufts and an opposite side having a plurality of stitches of face yarn;

applying to a plurality of the stitches a stitch bind composition having a viscosity effective for coating or penetrating the stitches to contact the filaments thereof ranging from about 0.5 to 2900 cps and comprising an aqueous liquid component that boils or vaporizes at a temperature such that it can be removed by heating below a temperature at which the tufted backing is damaged by heat and an organic polymer component that bonds filaments of the stitches on removal of the aqueous liquid component, wherein the stitch bind composition is applied in an amount effective to provide about 0.2 to about 3 ounces of the organic polymer component or a residue thereof per square yard of the stitched side;

contacting the tufted primary backing, an additional backing and a thermoplastic binder consisting entirely or essentially of a thermoplastic polyethylene resin having flow properties corresponding to an MI of about 2.2 to about 150 g/10 min. as measured in accordance with ASTM D 1238; and a viscosity between approximately 230,000 and 4,881,000 cps at about 270° F. with a shear rate of about 10 $sec^{-1}$ as measured in accordance with ASTM D 3835 and that softens or melts at a temperature below a temperature at which the tufted primary backing and the additional backing are damaged by heat or that, when softened or melted, can contact the tufted primary backing and the additional backing without such damage, to form an intermediate structure having the thermoplastic binder disposed between the stitched side of the tufted primary backing and the additional backing;

heating the tufted primary backing or the intermediate structure after application of the stitch bind composition to remove the aqueous liquid component without damaging the tufted primary or additional backing;

heating the thermoplastic binder to soften or melt the thermoplastic resin without damaging the tufted backing or the additional backing; and cooling the intermediate structure with the thermoplastic resin in softened or melted form to solidify the resin.

28. The process of claim 25 further comprising an additional step comprising contacting the stitched side of the tufted backing, the thermoplastic binder and an additional backing with the binder disposed between the stitched side and the additional backing such that the additional backing is bonded to the stitched side on cooling of the binder to solidify the resin.

29. The process of claim 28 wherein the additional backing comprises a secondary backing woven from polypropylene tapes or yarns.

30. The process of claim 28 wherein the additional backing comprises a thermoplastic binder.

31. The process of claim 28 wherein the additional backing comprises a fabric woven from polypropylene tapes or yarns with a thermoplastic binder in the form of a nonwoven fabric or fibers comprising a thermoplastic resin needled thereto.

32. The process of claim 25 wherein the stitch bind composition has a viscosity of about 1.5 to 400 cps.

33. The process of claim 26 wherein the thermoplastic binder is a nonwoven fabric needled to the backing.

34. The process of claim 33 wherein the backing comprises a fabric woven from tapes comprising polypropylene.

35. The process of claim 26 wherein the stitch bind composition has a viscosity of about 1 to about 1200 cps.

36. The process of claim 27 wherein the tufted primary backing comprises a fabric woven from tapes comprising polypropylene.

37. The process of claim 36 wherein the additional backing comprises a secondary backing fabric woven from polypropylene tapes or yarns.

38. The process of claim 37 wherein the viscosity of the stitch bind composition is about 1.5 to 400 cps.

39. The process of claim 27 wherein the additional backing comprises a secondary backing fibric woven from polypropylene tapes or yarns.

* * * * *

UNITED STATES PATENT AND TRADEMARK OFFICE

CERTIFICATE OF CORRECTION

PATENT NO. : 7,018,492 B1
APPLICATION NO. : 09/696519
DATED : March 28, 2006
INVENTOR(S) : Jeffrey H. Mumm et al.

It is certified that error appears in the above-identified patent and that said Letters Patent is hereby corrected as shown below:

Claim 1, column 46, line 14, change the phrase, "0.5 to 2900 cps and comprising an aqueous liquid compo-" to -- 0.5 to 3000 cps and comprising an aqueous liquid compo- --.

Claim 23, column 47, line 19, change the phrase, "bonded with a stitch bind composition comprising an" to -- bonded with an organic polymer --.

Claim 23, column 47, lines 20 - lines 25, delete the following phrase entirely, "organic polymer which is present at about 0.2 to about 3 ounces per square yard of the stitched side, the stitch bind composition having a viscosity effective for coating or penetrating the stitches to contact the filaments thereof ranging from about 0.5 to 2900 cps and comprising an aqueous liquid component."

Claim 24, column 48, line 9, change the phrase, "about 0.5 to 2900 cps an comprises and aqueous liquid" to -- about 0.5 to 3000 cps an comprises and aqueous liquid --.

Claim 25, column 48, line 33, change the phrase, "between proximately 230,000 and 4,881,000 cps at" to -- between approximately 230,000 and 4,881,000 cps at --.

Claim 25, column 48, line 48, change the phrase, "filaments thereof ranging from about 0.5 to 2900 cps" to -- filaments thereof ranging from about 0.5 to 3000 cps --.

Claim 26, column 49, line 20, change the phrase, "ranging from about 0.5 to 2900 cps and comprising" to -- ranging from about 0.5 to 3000 cps and comprising --.

Claim 27, column 49, line 43, change the phrase, "ranging from about 0.5 to 2900 cps and comprising an" to -- ranging from about 0.5 to 3000 cps and comprising an --.

UNITED STATES PATENT AND TRADEMARK OFFICE

CERTIFICATE OF CORRECTION

PATENT NO. : 7,018,492 B1
APPLICATION NO. : 09/696519
DATED : March 28, 2006
INVENTOR(S) : Jeffrey H. Mumm et al.

It is certified that error appears in the above-identified patent and that said Letters Patent is hereby corrected as shown below:

Claim 39, column 50, line 56, change the phrase, "backing comprises a secondary backing fibric woven from" to -- backing comprises a secondary backing fabric woven from --.

Signed and Sealed this

Fourth Day of November, 2008

JON W. DUDAS
*Director of the United States Patent and Trademark Office*